US007889042B2

(12) United States Patent
Meinke

(10) Patent No.: US 7,889,042 B2
(45) Date of Patent: Feb. 15, 2011

(54) HELICAL COIL DESIGN AND PROCESS FOR DIRECT FABRICATION FROM A CONDUCTIVE LAYER

(75) Inventor: Rainer Meinke, Melbourne, FL (US)

(73) Assignee: Advanced Magnet Lab, Inc., Palm Bay, FL (US)

( * ) Notice: Subject to any disclaimer, the term of this patent is extended or adjusted under 35 U.S.C. 154(b) by 0 days.

(21) Appl. No.: 12/388,306

(22) Filed: Feb. 18, 2009

(65) Prior Publication Data

US 2009/0206974 A1 Aug. 20, 2009

Related U.S. Application Data

(60) Provisional application No. 61/029,423, filed on Feb. 18, 2008.

(51) Int. Cl.
*H01F 5/00* (2006.01)
*H01F 27/28* (2006.01)

(52) U.S. Cl. ..... 336/200; 336/170

(58) Field of Classification Search ..... None
See application file for complete search history.

(56) References Cited

U.S. PATENT DOCUMENTS

| | | | | |
|---|---|---|---|---|
| 3,197,680 | A | 7/1965 | Wingerson | |
| 3,466,743 | A | 9/1969 | Puy | |
| 3,761,752 | A | 9/1973 | Anderson | |
| 3,815,069 | A * | 6/1974 | Palazzetti et al. | 336/200 |
| 4,283,687 | A | 8/1981 | Madey | |
| 4,639,708 | A | 1/1987 | Weatherly | |
| 5,241,293 | A * | 8/1993 | Okumura | 336/183 |
| 6,921,042 | B1 | 7/2005 | Goodzeit | |
| 7,425,884 | B2 * | 9/2008 | Suzui | 336/200 |
| 2001/0033214 | A1 | 10/2001 | Bircann | |
| 2002/0069512 | A1 * | 6/2002 | Adams et al. | 29/606 |
| 2003/0184427 | A1 | 10/2003 | Gavrilin | |

FOREIGN PATENT DOCUMENTS

| | | |
|---|---|---|
| CA | 968398 | 5/1975 |
| EP | 0077240 | 4/1983 |

(Continued)

OTHER PUBLICATIONS

Meinke et al., Superconducting Double-Helix Accelerator Magnets, 2003 Particle Accelerator Conference, IEEE.*

(Continued)

*Primary Examiner*—Anh T Mai
(74) *Attorney, Agent, or Firm*—Ferdinand M. Romano; Beusse, Wolter, Sanks, Mora & Maire, P.A.

(57) ABSTRACT

A conductor assembly of the type which, when conducting current, generates a magnetic field or in which, in the presence of a changing magnetic field, a voltage is induced. According to an exemplary embodiment a conductor is positioned along a path of variable direction relative to a reference axis. The conductor has a width measurable along an outer surface thereof and along a series of different planes transverse to the path direction. The measured conductor width varies among the different planes. In one example, the conductor path is helical, positioned about the axis between turns of helical spaces, and the conductor width varies as a function of the azimuth angle.

20 Claims, 22 Drawing Sheets

FOREIGN PATENT DOCUMENTS

| | | | |
|---|---|---|---|
| EP | 0186998 | | 7/1986 |
| EP | 0350268 | | 1/1990 |
| EP | 0353153 | | 1/1990 |
| EP | 0954009 | A | 11/1999 |
| FR | 2550026 | A | 2/1985 |
| GB | 1502490 | | 3/1978 |

OTHER PUBLICATIONS

Bird M D et al, "New Concepts in Transverse Field Magnet Design" IEEE Transactons on Applied Superconductivity, IEE Service Center, Los Alamitos, CA vol. 13, No. 2, Jun. 1, 2003, pp. 1213-1216.

Caspi, et al, "Design Fabrication and Test of Superconducting Dipole Magnet Based on Tilted Solenoids" IEEE Transactions on Applied Superconductiviity, IEEE Service Center, Los Alamitos, CA, vol. 17, No. 2, Jun. 1, 2007, pp. 2266-2269.

Ball, MJ et al, Modulated Double Helix Quadrupole Magnets, IEEE Transactions on Applied Superconductivity, Service Center Los Alamitos CA, US vol. 13, No. 2—Jun. 1, 2003, pp. 1369-1372.

Ball, MJ et al, "The Double Helix dipole- a novel approach to Accelerator Magnet Design" IEEE Transactions on Applied Superconductivity, IEEE Service Center Los Alamitos, CA, US, vol. 13, No. 2—Jun. 1, 2003, pp. 1365-1368.

* cited by examiner

CR/10

300

300

HELICAL COIL DESIGN AND PROCESS FOR DIRECT FABRICATION FROM A CONDUCTIVE LAYER

RELATED APPLICATION

This application claims priority to provisional patent application U.S. 61/029,423 filed 18 Feb. 2008 which is incorporated herein by reference in the entirety.

FIELD OF THE INVENTION

This invention relates to electromagnetic systems which generate magnetic fields. More particularly, the invention relates to systems of the type including conductor assemblies which, when conducting current, generate a magnetic field or which, in the presence of a changing magnetic field, generate or transform voltages. Application of electromagnetic systems in new and improved commercial applications requires development of more efficient systems to provide high quality, stable and uniform fields improved efficiency can result in smaller form factors, resulting in a combination of new uses and lower costs. For example, it is desirable to increase the current density through magnetic coils while reducing the electrical resistance. In addition to providing improved coil transfer functions, it is also desirable to meet demands for relatively large, stable and uniform magnetic fields with lower energy costs and more compact systems. With development of smaller magnetic conductor assemblies capable of generating suitable field strengths, new medical applications can move from R&D to widespread use in patient treatment.

Further miniaturization of magnetic coils capable of generating relatively strong fields can permit procedures such as local treatment of diseases and lower cost deployment of surgical procedures with magnetic steering. It is also desirable to make charged particle therapy cancer treatment (e.g., proton and carbon therapy) more available to patients. Presently, the treatment systems require large cyclotrons and very large beam steering magnets to deliver high energy charged particles with precision. System size and cost severely limit the availability of these applications. Currently, the gantries used for proton therapy treatment rooms may extend multiple stories in height and weigh over one hundred tons. Clearly, the size and cost of the beam acceleration and focusing equipment is an impediment to further deployment of these and other charged particle beam systems.

To the extent superconducting magnetic coils could be used in a few of the foregoing example applications, e.g., charged particle therapy and certain other magnetic field applications, they may be preferred over resistive magnets because superconducting magnets can provide very stable and relatively high field strengths with a smaller form factor. Use of superconducting magnets in carbon-based systems for charged particle cancer treatment may be imperative in order to meet the bending requirements of the high energy carbon beam. That is, coil segments used to bend beams are very complex and must be very stable in order to implement a curved trajectory. Further, it is very difficult to apply conventional geometries, e.g., saddle coil and race track configurations, to curvilinear applications and still meet requirements for field specifications.

On the other hand, although power demands of superconducting magnets are lower than those of resistive magnets, suitable applications of superconducting magnets are limited. In part, this is due to complexity of cryogenic systems and potential for quenching. There are many potential applications which demand field strengths in excess of the achievable current densities of superconductors and in those applications when a superconducting design is capable of generating the requisite fields, stability may be a concern. If the superconducting material undergoes an unexpected and rapid transition to a normal, non-superconducting state this can result in rapid formation of a high temperature hot spot which can destroy the magnet. Designs which improve stability and, therefore, reliability, are costly and cost has posed a major constraint to greater commercialization of conventional superconducting magnet technologies. Also, while it is, in principle, desirable to utilize high temperature superconductors for electromagnetic systems, many of the known materials have physical properties which limit commercial uses. Some materials are brittle and, for others, technology has yet to be developed for creating windings which would conform to a small radius of curvature. For a given set of operating conditions, significant design efforts and manufacturing costs are required to achieve field uniformity specifications and to assure that quenching does not occur during normal system use.

The foregoing illustrates that a complex combination of technical issues surround the many applications of high performance electromagnetic coil systems. Whether future systems employ resistive or superconductive windings, there is continued need to improve design efficiency, reliability and field quality. At the same time, it is necessary to provide these systems at lower costs in order to encourage wider uses that benefit society. By way of illustration, current designs of mechanical structures that assure stabilization of conductor windings in the presence of large fields are a significant factor in overall weight and system cost. Also, with rotating machinery being subject to wear under conditions of continued use, there are needs to provide costly maintenance and repair. Design improvements which substantially reduce these life cycle costs and the overall affordability of high field systems can accelerate deployment of useful systems that require generation of large magnetic fields.

SUMMARY OF THE INVENTION

The invention relates to magnetic coils similar to coils of the type disclosed in U.S. Pat. No. 6,921,042, now incorporated herein by reference, for "Concentric Tilted Double-Helix Dipoles and Higher-Order Multipole Magnets", issued Jul. 26, 2005 and referred to herein as the '042 patent. The '042 patent describes straight magnet geometries with fields that are constant along the magnet axis. An embodiment has been suggested for a thin conductive surface layer applied to a core with a conductor coil pattern formed thereon according to the 3-dimensional space curve:

$$X(\theta) = \frac{h}{2\cdot\pi}\cdot\theta + A_n\cdot\sin(n\cdot\theta)$$

$$Y(\theta) = R\cdot\cos(\theta)$$

$$Z(\theta) = R\cdot\sin(\theta)$$

wherein X is along a coordinate parallel with the axial direction and Y and Z are along directions transverse thereto and orthogonal to one another. θ is the azimuth angle measured in a Y-Z plane transverse to the X-axis. The parameter h defines the advance per turn in axial direction (X). R is the aperture of the winding pattern. An example of such a winding is shown in FIG. 14 of the '042 patent. The defined coil pattern could be formed by removal of material, leaving a groove into the surface layer.

According to embodiments of the invention, a manufacturing process begins with provision of an electrical conductive core or a layer that is bonded or deposited onto a core support structure. A groove, fully penetrating through the conductive material is cut into the core or layer such that a conductive path along the core surface remains, which forms a winding or coil row suitable for generating a magnetic field or which, in the presence of a changing magnetic field, induces a voltage. The groove cut into the conductive material leaves a void or space which electrically isolates adjacent winding turns from one another.

Multi-layered coil configurations may be obtained by combining such coils or layers (referred to herein as coil rows) in a concentric configuration with the turns in different coil rows insulated from each other, although the conductor forming each coil row may be electrically wired in series to conductor in one or more other rows to create a multi-level magnetic system. That is, coil ends formed along each core or layer can be connected to coil ends in one or more other cores such that a continuous conductor path results for the multi-layered structure. In such an embodiment gaps can be introduced between the multitude of cores, or layers of coil turns, which allow coolant to make contact with multiple sides of the conductor for highly effective removal of heat generated by the conductor.

In a series of embodiments according to the invention, design and manufacturing methods are provided to directly create a continuous conductor path along a tubular shaped structure having a conductive outer surface. In one set of embodiments, a continuous helically-shaped conductor has varying material widths (measurable across cross sections taken along planes transverse to the conductor path) which can reduce the total resistance of the conductor while still maintaining desired magnetic field characteristics. The conductor cross sections can be adjusted and optimized to provide desired field characteristics and electrical properties. The conductive outer surface that forms the winding pattern may be a layer formed on a tubular substrate or may be the surface of a conductive tube formed, for example, of extruded copper, or may be a metallic casting. The thickness of the outer conductor surface is not limited and certainly can range at least from microns to multiple centimeters.

Examples of design and manufacturing methods involve an electrically conducting tube positioned about a substrate wherein portions of the conducting tube are machined away or otherwise removed, e.g., chemically, to leave a continuous conductor path. The path may be in the form of a tilted helix formed along the shape of a regular cylinder, but other multipole field configurations and combinations of multipole field configurations are contemplated. The invention provides multi-layer coil embodiments analogous to structures disclosed in U.S. application Ser. No. 12/061,797 now incorporated herein by reference, for "Wiring Assembly and Method of Forming a Channel in A Wiring Assembly For Receiving Conductor And Providing Separate Regions of Conductor Contact with the Channel" filed 3 Apr. 2008, and referred to herein as the '797 patent. For each layer or coil row, a conductive coil pattern formed along a cylinder or other shape may be bonded or otherwise attached to a layer of insulator which may provide the function of a stabilizing substrate. Alternately, concentric coil rows may be formed with gaps between adjacent rows. The gaps may provide passages for movement of liquid or gaseous coolants.

Generally, a desired conductor profile may be formed along the surface of a solid shape, e.g., a cylinder or ellipsoid, by any of numerous known techniques such as machining with a tool, etching or laser cutting. All conductive material in regions along, but outside of, a predefined conductor path is removed, leaving a void which may simply provide a spatial gap between open loops of the coil, or which may be filled with suitable dielectric material. In some embodiments, the voids can be filled with epoxy to provide desired mechanical strength and dielectric properties or may be used as one or more cooling channels, e.g., for flow of water or liquid nitrogen along the surface of the conductor; or for placement of dielectric material having suitable thermal conductivity which results in a heat path for removing thermal energy from the conductor. In this regard, the coolant may be in direct contact with the conductor. Further, the level of cooling can be improved by introducing gaps between conductor layers, i.e., coil rows, and by defining surface features (e.g., grooves or a rough texture) along the conductor which facilitate transition of fluid movement into local turbulences as opposed to, for example, a laminar-like flow. If compared to conventional cooling techniques, wherein coolant flows through tubes, the combination of gaps and surface features can result in an overall lower path resistance for coolant flow and an enhanced removal of heat.

Embodiments of the invention may incorporate double helix winding configurations based in part on concepts described in the '042 patent, but winding geometries may vary from turn-to-turn and from layer-to-layer to achieve desired field configurations and field quality characteristics such as described in copending U.S. patent application Ser. No. 12/133,645, now incorporated by reference, for "Conductor Assembly Including A Flared Aperture Region" filed 5 Jun. 2008. Relative to conventional "wire" wound coils, a larger number of choices of conductive materials are suitable for embodiments according to the invention, including copper, pure aluminum, alloys and numerous types of superconducting materials. Very robust coil windings can be formed. Generally, many conductive materials that do not lend themselves to conventional wire manufacture or wire winding processes are available to practice the present invention, including those which might lose integrity under bending stresses or which simply do not conform to required bending in order to achieve a desired radius of curvature. For example, the invention allows the use of superconducting materials in thin sheets or tube shapes. In other embodiments high temperature superconductors like YBCO can be used in the invented process by directly depositing layers of the material on to an appropriate substrate material as used in the manufacturing of tape conductors of the same superconductor. In such applications multi-layered coils can be manufactured with a very small radial build-up, e.g., minimum coil thickness, since conductor layers formed of superconductors like YBCO are typically only 1 or 2 microns thick. Such embodiments are useful for high temperature superconductors which are of a brittle nature and have limitations on achievable bending radii. Coil assemblies made of such materials can exhibit feature sizes on the mm scale or smaller.

Also, because the conductive coils may be formed in-situ with a material removal process, the invention allows for accommodation of very "large" conductors, i.e., having large cross sectional areas, without encountering many of the difficulties which might result from conforming even a round-shaped extruded wire of comparable size to a helical pattern. On the other hand, very small and fine line geometries for coil configurations can be attained via, for example, an etching, or laser, or electron beam, removal process. Thus embodiments of the invention are well-suited for medical devices and small sensors. Examples include magnetic resonance imaging applications and magnetically steered catheters. Further, the invention allows provision of variable conductor cross section along each turn or loop in a helical pattern to further reduce resistance, or to optimize field shape. The invention is not limited to forming helical coil shapes about an axis of symmetry and may be applied to create many conventional and nonconventional geometries along surfaces of varied shape by removal of material. Instead of forming the conductor profile in the surface of a regular, e.g., circular, shaped cylinder, the "cylinder" or core may be non-circular, i.e., rectangular, elliptical or assymetrical. The core may extend along a nonlinear axis. Embodiments of the invention enable formation of conductive patterns having very small radii of curvature otherwise not attainable with conventional wire winding techniques.

According to a first series of embodiments of the invention, there is provided a conductor assembly of the type which, when conducting current, generates a magnetic field or in which, in the presence of a changing magnetic field, a voltage is induced. According to an embodiment, a conductor is positioned along a path of variable direction relative to a reference axis. The conductor has a width measurable along an outer surface thereof and along a series of different planes transverse to the path direction. The measured conductor width varies among the different planes. The conductor path may be helical, positioned about the axis between turns of helical spaces, and the conductor width may vary as a function of azimuth angle.

Figure 1:
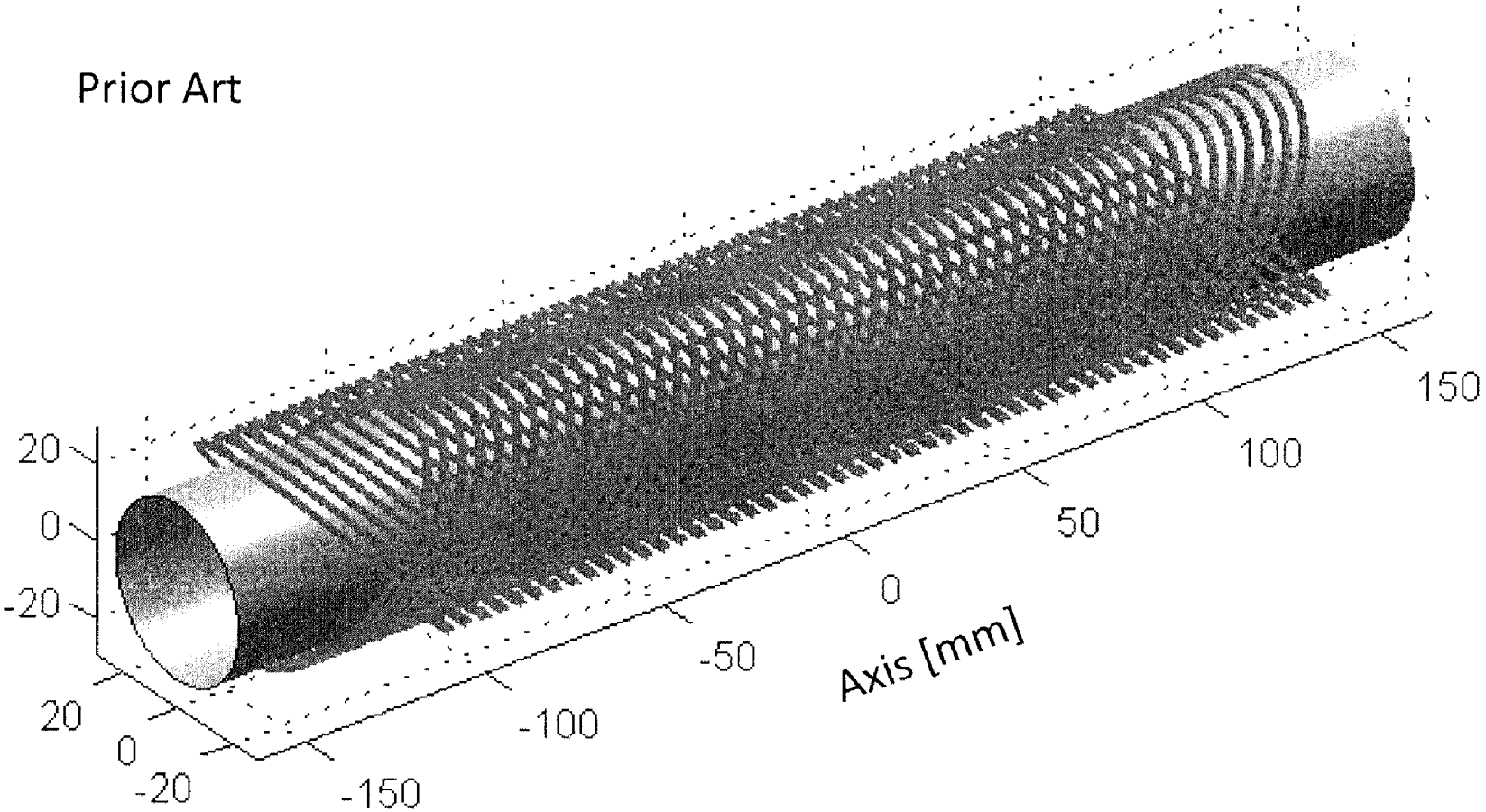
FIG. 1 is a perspective view which illustrates a prior art two-layer double-helix winding.

Like reference numbers are used throughout the figures to denote like components. Numerous components are illustrated schematically, it being understood that various details, connections and components of an apparent nature are not shown in order to emphasize features of the invention. Various features shown in the figures are not shown to scale in order to emphasize features of the invention.

DETAILED DESCRIPTION OF THE INVENTION

Before describing in detail examples of inventive systems, components and methods, it is noted that features of the present invention include novel and non-obvious combinations of components and process steps. So as not to obscure the disclosure with details that will be readily apparent to those skilled in the art, certain conventional components and steps have been omitted or presented with lesser detail, while the drawings and the specification describe in greater detail other elements and steps pertinent to understanding the invention. Further, the following embodiments do not define limits as to structure or method according to the invention, and provide examples which include features that are permissive rather than mandatory and illustrative rather than exhaustive.

As used herein, the terms coil, spiral, helix and helical include but are not limited to regular geometric patterns. In addition, the terms coil, spiral and helix include configurations wherein a width (e.g., along the axial direction) or a thickness (e.g., along a radial direction or transverse to the axial direction) may vary. Reference to a type of shape (e.g., cylindrical) is not limited to a symmetrical or regular shape thereof. For example, references to a tubular or cylindrical body are not limited to a regular geometry along a symmetric axis but may, for example, include asymmetric shapes relative to an axis, such as tubes of rectangular, elliptic or irregular shape. Contemplated embodiments include variations which depart substantially from regular geometries. Both regular and irregular geometries may not be simply described in closed form. Numerical solutions, proximate as they may be, can be applied to model and design wiring configurations which may then be constructed accordingly to a desired level of precision.

Further, terms such as winding, helical winding, wiring pattern and coil configuration as applied to physical embodiments formed of various conductor and/or insulative materials, are used without regard to how the materials are formed in place. That is, although it is conventional to physically wind a strand of conductor in the configuration of a spiral, the foregoing terms as used herein refer to the resulting configuration and not the methodology used to form the pattern. So, for example, a coil or winding may be formed from a cylindrical body by removal of body material, this resulting in a shape that corresponds to a spiral winding. Advantageously, forming such a winding pattern is not dependent on malleability of the conductor or ability to withstand bending stresses or strain. In addition, the void resulting from the removal of material may also correspond to a spiral shape.

References made herein to the cross section of a conductor, such as a spiral winding or other wire, refer to a cross section in a plane transverse to the direction along which the conductor extends. The direction along which the conductor extends may be defined by the aforedescribed 3-dimensional space curve or other analytics descriptive of the space curve such as further described below. Generally, as used herein, the cross section of a conductor is a local cross section at a point on the space curve. At any given point on the space curve the cross section corresponds to a view taken along a plane transverse to the tangent vector which describes the direction of the path at that same point. The cross section is descriptive of the size and shape of the conductor as viewed along the transverse plane.

With coils helically-wound about an axis to produce magnetic field components transverse to the axis, cancellation of axial field components can be effected by the formation of coils in concentrically positioned pairs having opposite tilt angles, this sometimes resulting in a high quality transverse field, e.g., a uniform dipole with essentially no higher order components. See, for example, Goodzeit et al., "The Double-Helix Dipole—A Novel Approach to Accelerator Magnet Design", *IEEE Transactions on Applied Superconductivity*, Vol. 13, No. 2, June 2003, pp. 1365-1368, which describes analytics for a double helix magnet geometry. Generally, however, in wiring assemblies having multiple pairs of coils with each coil helically-wound about an axis to produce transverse and axial magnetic field components, it is not necessary that members of pairs having opposite tilt angles, to control or eliminate transverse axial components with respect to one another, be immediately next to one another in the sequence of coil rows.

For helically wound conductors and other magnet geometries, some of these being racetrack and saddle configurations, placement of conductor has been problematic for multiple reasons. In conventional racetrack and saddle configurations, based on circular-shaped cable, the position of each wire turn has depended on the position of a previous wire turn. Such windings typically build on one another with a second row of turns being tightly wound over a previously wound row of turns. The windings are often generated with assistance of tooling that assures consistency as turns in each row are wound tightly against one another and as turns in consecutive rows are created one over the other. This tight stacking of turns has provided a means to stabilize the conductor. Further, this type of configuration often results in contact between turns in the same row as well as between turns in adjoining rows, and has required insulative coating on the conductor surface so that portions of the conductor coming into contact with other portions of the conductor are insulated from one another. To assure stability of the winding under high field conditions the turns are commonly bonded to one another with an adhesive.

In these prior systems the position and stability of the conductor has depended on the positioning of each conductor turn against another conductor turn, or against inserted spacers, and the ability to maintain the conductor in a static position during manufacture, assembly, and operation, i.e, under typical thermal cycling and high Lorentz forces acting during coil excitation. While the required tight nesting of turns of insulated wire without intervening layers can stabilize the conductor, the design of the wiring pattern has been limited and, thus, variation in design of the field pattern has also been limited. The '797 patent illustrates a series of designs which render it possible to more fully utilize other wiring patterns without compromising reliability. As shown with examples illustrated in the '797 patent, concentric coil rows, i.e., rows of conductor segments, may be separated with intervening insulative layers. Channels formed in the insulative layers pre-define the positions for wiring patterns. After placement of wire in each coil row channel, another insulative layer is formed over the positioned wire, thereby further securing the wire to prevent movement in the presence of large Lorentz forces. According to the '797 patent, it is recognized that formation of channels into which the conductor is inserted provides precise conductor positioning and stabilization while also isolating portions of the conductor from other portions of the conductor. The conductor pattern and the corresponding channel path can be formed in a relatively tight helical configuration wherein h, the advance per turn in an axial direction, is so small that portions of the conductor in adjacent turns come very close to or into contact with one another. In embodiments where contact between adjacent portions of conductor turns is a concern, the conductor has an insulative coating.

The term "conductor" as used herein refers to a conductor segment of elongate proportion, i.e., a string-like piece or filament of relatively rigid or flexible material. The conductor may take a form having circular, quadrilateral or other shape in cross section. The term cross section as used herein refers to a section of a feature, e.g., of a conductor or an aperture or a coil, taken along a plane which is transverse to a definable axis through which the feature extends. If the coil row axis is curvilinear about a point of interest on the axis, the plane along which the cross section is taken is understood to be transverse to the direction of a vector which is tangent to the direction of the axis at the point of interest.

A first example of a coil configuration according to the invention, referred to as a Direct Coil, and an associated, exemplary design process are described for a dipole coil. The following description is limited to a single layer coil or coil row, and the process of forming additional layers may follow the same procedure. The exemplary Direct Coils are helical in shape, being formed from a core having the shape of a regular cylinder, but more generally the configuration is referred to herein as a Direct Helix, or a Direct Helix coil.

As for conventional coils, the design begins with provision of specifications for the dipole coil. Parameters relevant to the design of the dipole coil include the coil aperture radius, R, and the coil length, which in the following example are, respectively, 50 mm and 300 mm. Other parameters, including the current carrying capacity, field uniformity and achievable field strength will vary depending on choice of materials and values of numerous parameters determining the three dimensional space curve. For a given coil aperture and coil length, it is often desirable to attain the highest possible field strength in a continuous, normal (resistive) conducting operation. In any magnet coil the achievable field strength is limited by the current density that can be applied to the coil without overheating the windings or, in case of superconductors, without exceeding the critical current. For coils formed with normal (resistive) conductor, it is therefore important to have a low resistance and a highly efficient cooling scheme. Minimization of resistance may be achieved by adjusting one or more variables, such as the shape or area of the conductor in cross section and the specific resistance. A feature of the invention provides for reduced resistance based on current density, conductor shape and temperature.

In a first example of a Direct Helix coil the design assumes a requirement for a highly uniform transverse field, which may be effected by basing the coil design on a double-helix coil configuration. The 3-dimensional conductor space curve for a filament of wire forming one coil row in such a multi-layer helical coil design is given by the following parametric representation in Cartesian coordinates:

$$X(\theta) = \frac{h}{2\cdot\pi}\cdot\theta + \sum_n A_n \cdot \sin(n\cdot\theta + \phi_n)$$

$$Y(\theta) = R\cdot\cos(\theta)$$

$$Z(\theta) = R\cdot\sin(\theta)$$

Equation 1 wherein the X coordinate is along the axis of the coil, Y and Z coordinates are in a plane transverse to X. θ is the azimuth angle in the Y-Z plane, h is the turn to turn advance of the winding, $A_n$ is a modulation amplitude of a sinusoidal modulation, which has a phase advance $\phi_n$, and R is the aperture radius of the winding. For a dipole field the summation over multiple modulations is limited to one term, i.e., n=1, wherein the coil pattern forms a helical configuration in which the individual turns are tilted in respect to the transverse Y-Z plane. This tilt angle α is determined by the amplitude $A_1$. When $A_1$ equals R the resulting tilt angle, α, is 45 degrees and increases with the size of the amplitude.

More generally, $$X(\theta)=[h/(2*\pi)]\theta\pm\Sigma A_n f_1(n\theta)$$

$$Y(\theta)=Rf_2(\theta)$$

$$Z(\theta)=Rf_3(\theta)$$

Equation 1A wherein the functions $f_1$, $f_2$ and $f_3$ are arbitrary functions which may be trigonometric or numerical expressions but are not so limited. For the illustrated embodiments the functions $f_1$, $f_2$ and $f_3$ are as disclosed in Equation 1, which defines the conductor path for a single layer or coil row. As is explained in the '797 patent, a single layer winding of the helical path contains not only a transverse field, but also an axial field component. The axial field can be canceled by adding a second layer which has the opposite tilt angle and the appropriate current direction so that the transverse fields of both layers add and the axial fields cancel. An example of such a 2-layer double-helix winding is shown in FIG. 1. However, embodiments according to the invention are not limited to those which so add transverse fields of different layers and cancel the associated axial fields.

The magnetic field of the double-helix winding shown in FIG. 1 can be calculated with the Biot-Savart Law. The field calculation may assume an infinitely thin filament that follows the 3-D space curve of Equation 1. Alternately, as illustrated for another embodiment, the field calculations may be based on a more complex set of assumptions to more accurately represent the field generated by the conductor shape. Generally, the magnetic field can be calculated for any point in space. In the past, field calculations, for which a simplistic approximation with thin filaments is used to approximate the actual conductor, has been suitable for conductors having circular shapes in cross section. That is, when the filament path follows the path of the center of the circular conductor shape, the field can be calculated at arbitrary points in space with a high degree of accuracy.

Embodiments of the coil geometry which differ from the first example include conductor geometries which are not circular in cross section but which may provide a tilted helical winding pattern as described above. The resulting configurations are characterized by lower resistance, more efficient cooling and higher achievable field strength relative to former double helix designs having the same coil aperture radius, R, coil length and field quality.

Design of the Direct Helix coil of Example 1 may begin by first defining a tool path, rather than a conductor path, with the space curve of Equation 1 along which a router bit with a given diameter cuts a fully penetrating groove, G, into a conductive layer having a cylindrical shape. By fully penetrating it is meant that the bit cuts all the way through the material so that loops are created about an axis in, for example, a helical configuration.

Figure 2:
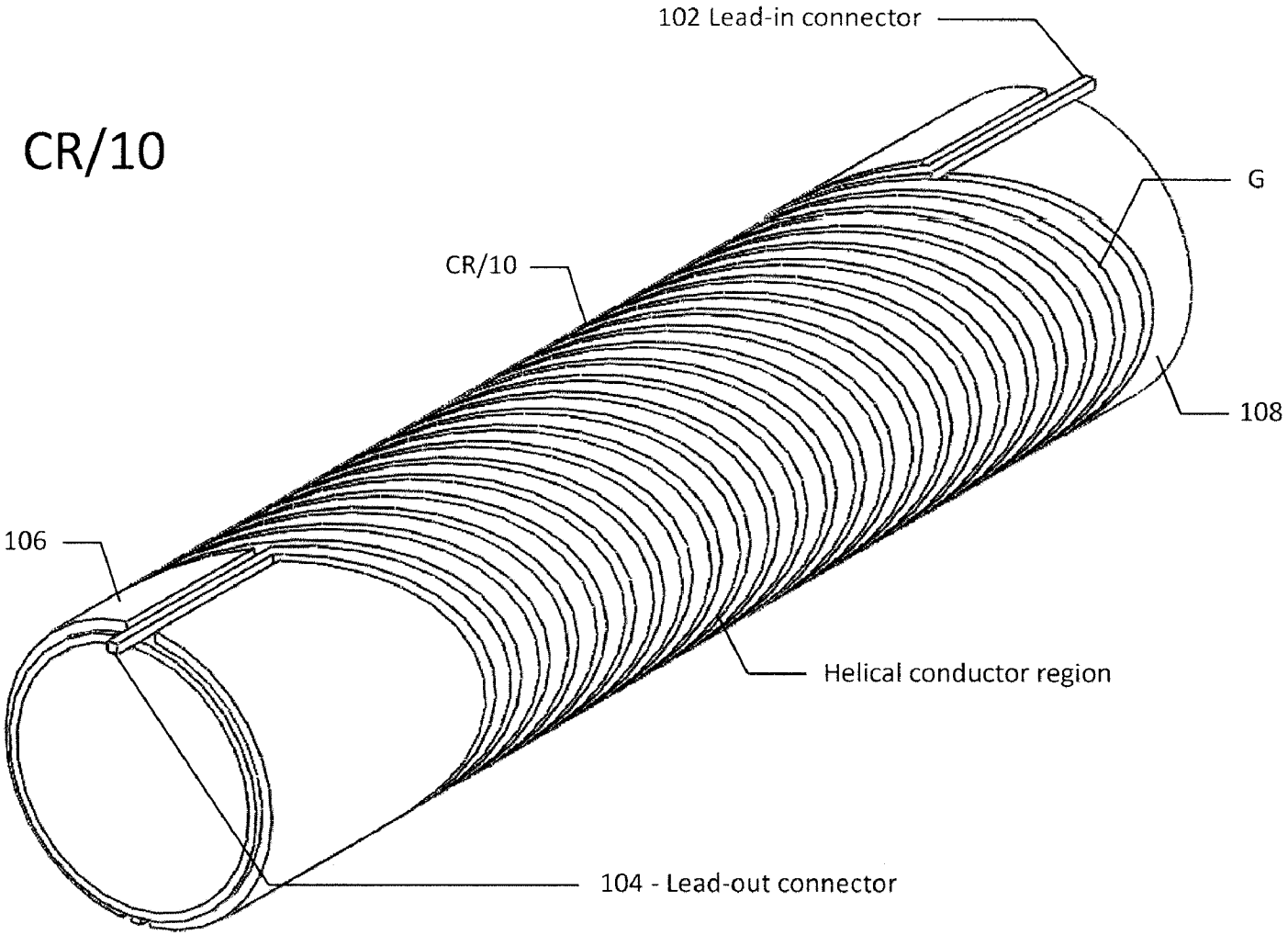
FIG. 2 is a perspective view of a helical coil row according to a Direct Helix embodiment of the invention.

In the current example the layer is in the form of a self-supporting aluminum tube 10, but may be a coating provided on a tube-shaped structure, or may be an insulative layer which is later coated with conductor or is converted into material having conductive properties. The tube may also be formed from a conductive sheet which is shaped into a cylinder and welded at the seam to provide a continuous surface. The inner diameter of the cylinder of the first example may be equal to the required coil aperture of 50 mm or more generally in the range of 40-60 mm. The machined groove provides a space, also referred to as an insulative groove, G, between the turns of the helical winding pattern that is generated. FIG. 2 illustrates the tube 10 after formation into a coil row CR The width, $W_g$, of the insulative groove, which is the distance between neighboring winding turns, is given by the cutting width, e.g., diameter, of the router bit. The coil row of FIG. 2 has been formed with a router bit having a characteristic fixed cutting diameter and corresponding cutting radius. During fabrication, a mandrel (not shown in FIG. 2) is fixedly positioned within the aperture of the aluminum tube 10. The mandrel is used to mount the tube 10 on a lathe or on a CNC machine for tooling with the router bit, and also provides a stiffening support to the tube.

Figure 3A:
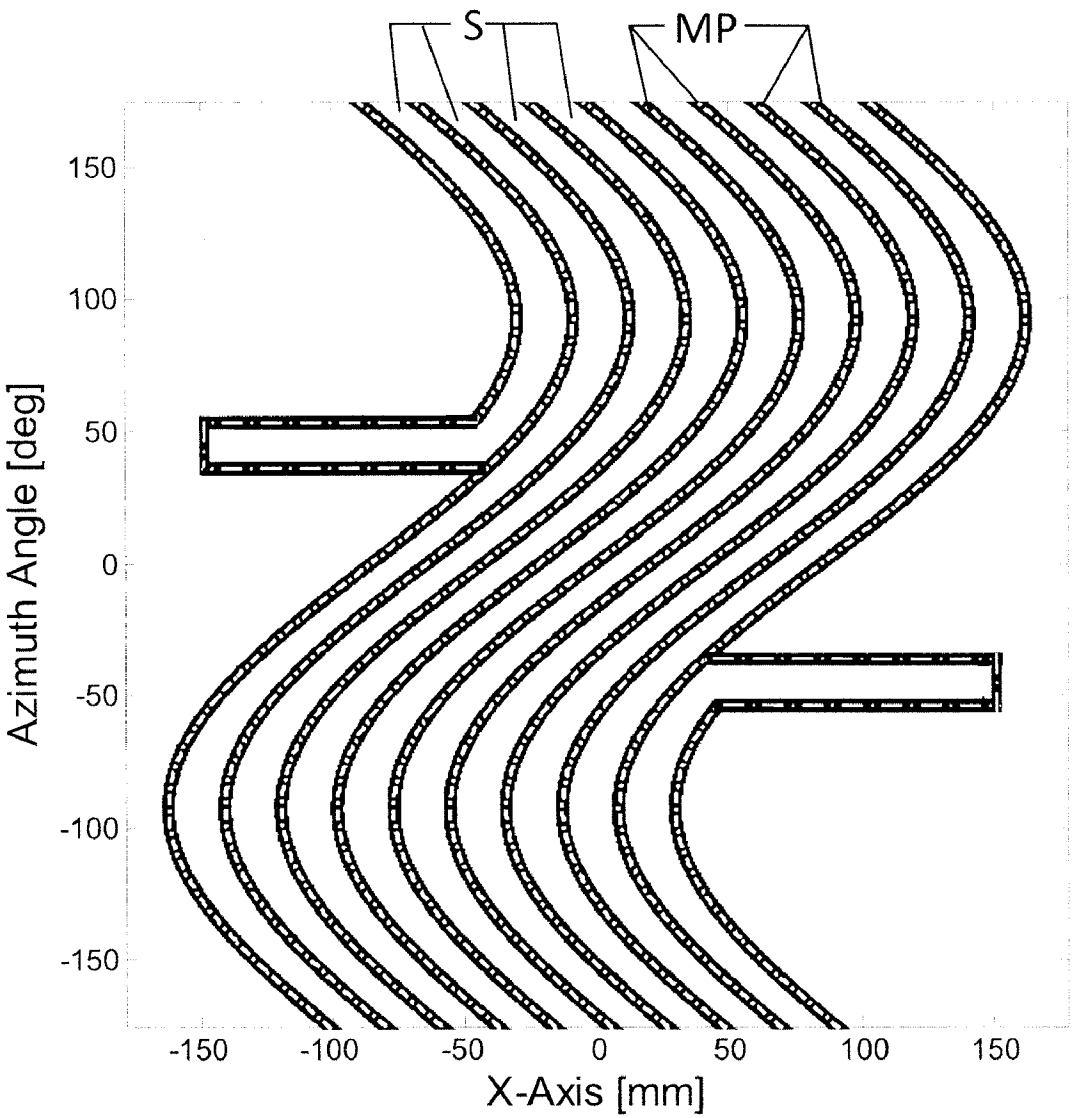
FIG. 3A is an unrolled view of a direct helix coil according to an embodiment of the invention.

Generally, once a helical groove is formed, by removal of conductor material from a path defined by a three dimensional space curve, a coil row having a helical pattern remains. This is illustrated in the unrolled view of FIG. 3A for a coil having nine full (360°) coil turns. Generally, as used herein, the term "unrolled view" means, with reference to a three dimensional helical pattern, a view of the pattern mapped into a plane to provide a two dimensional view having a range of 2π about the axis of the coil row, e.g., the X axis. Thus, in such a representation the abscissa is the X-coordinate of the pattern, and the angle θ is the ordinate. In the example of a single layer pattern shown in FIG. 3A, each strip S corresponds to a 360° coil turn. The center of the machine path MP through which the groove G has been formed is indicated by dotted lines.

Merely cutting a helical groove into a conductor will not result in a sufficient conductor path to create a magnetic coil. According to the invention, and as further shown in the partial schematic view of an unrolled coil pattern in FIG. 3B, additional machined grooves, labeled "Line-in a", "Line-in b", "Line-out a" and "Line-out b" are needed to form lead-in and lead-out connectors and complete a continuous current path that form current entry and exit terminals to the coil winding.

Figure 3B:
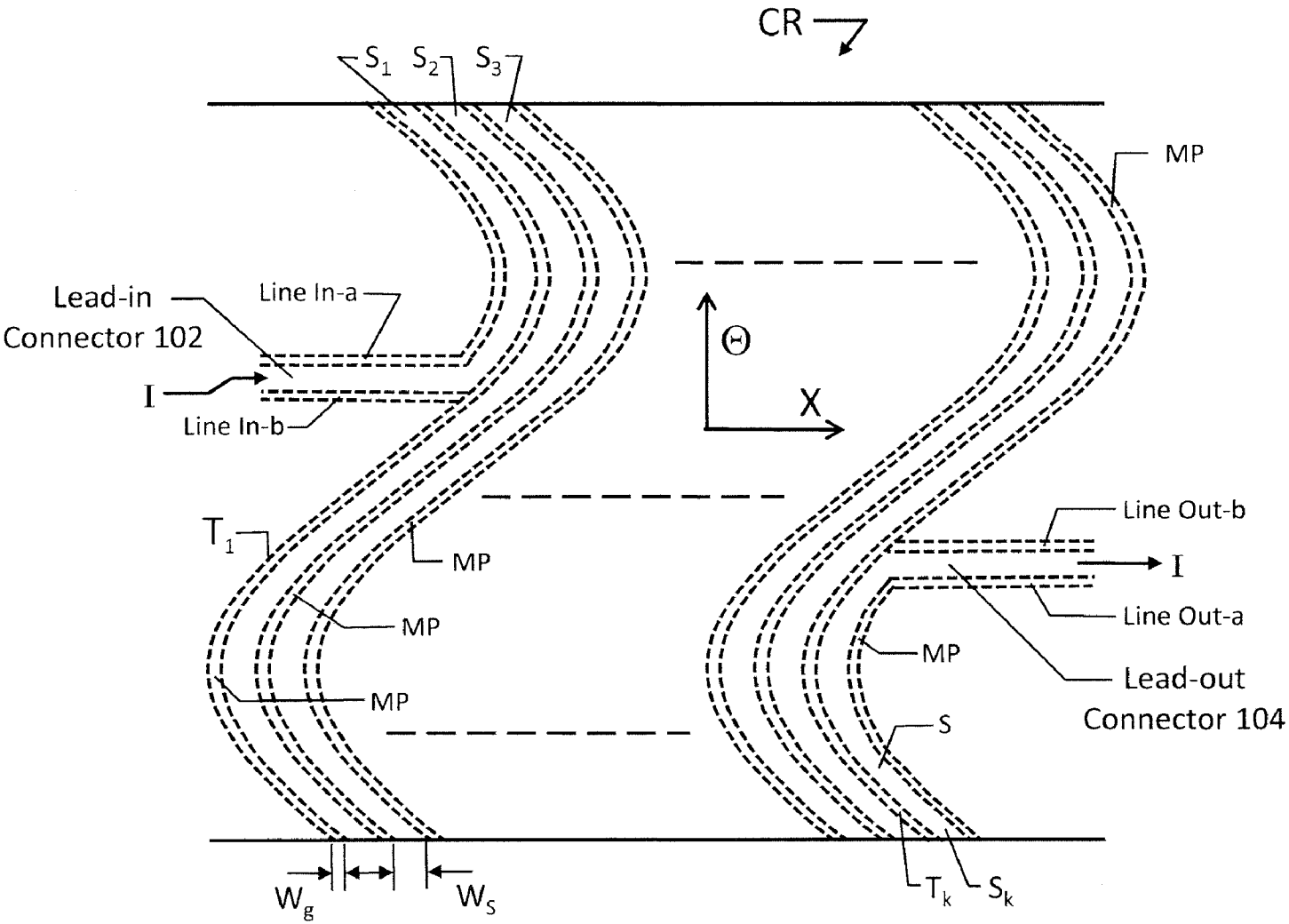
FIG. 3B is another unrolled view of a direct helix coil according to an embodiment of the invention.

Pairs of dashed lines shown in the unrolled view of FIG. 3B represent the router bit trajectory along illustrated machine path turns $T_i$. The turns $T_i$ are defined by the outer limits of the router bit cutting edges which are centered with respect to the machine path, MP. The turns $T_i$ correspond to the insulative void which results after the conductive material is removed. The remaining strips, S, of conductive material, indicated in FIG. 3B, form the resulting helical-shaped conductor path of the machined tube 10 of FIG. 2. The paths MP may be formed by other methods such as etching and laser ablation.

With further reference to FIG. 3B, the machine path, MP, through which the groove G has been formed results in the continuous groove, G, along the coil row, having a groove width, $W_g$. See, also, FIG. 2. A feature of the illustrated embodiments is that, because the machine path, MP is formed by defining a center point of the tool path in accord with Equation 1 (as indicated by dashed lines in FIG. 3A), the resulting groove, G, is characterized by a constant groove width, $W_g$, along each of the machine path turns $T_i$ (shown in FIG. 3B) while the width of the conductor along all of the coil loops (referred to as the strip width, $W_s$) varies as a function of the angle θ.

The strips may have relatively large widths, $W_s$, resulting in a ribbon-like shape of relatively high width-to-thickness ratio, or an approximate rectangular shape (as shown for a view in cross section of a strip $S_i$ in FIG. 4) with a lower width-to-thickness ratio, or, as further discussed herein, a high thickness to width ratio, on the order of 10:1 or higher. Consistent with the helical shape of the illustrated dipole configuration, individual strips correspond to open loops of elliptical shape, each extending 360 degrees and connected end to end with another strip, but more complex modulations are contemplated, incorporating higher orders of n in accord with Equation 1. Generally, the strip widths may be constant or may vary as a function of the azimuth angle, θ.

To perform a field calculation and to estimate the resistance of the conductive strips, a mathematical description of the strips S is provided. With the strips, S, having approximately a rectangular shape, in cross section, it may not be sufficient to calculate the resulting magnetic field using those approximations which have been suitable for a conductor having a circular shape in cross section. In lieu of calculating the resulting magnetic field, e.g., with a single infinitely thin filament that is centrally located within the strip, a more accurate design method as now described may be applied for both modeling and modifying the pattern of the strips. The method incorporates optimization procedures to achieve desired performance criteria for field uniformity, coil resistance and other parameters of interest.

Figure 4:
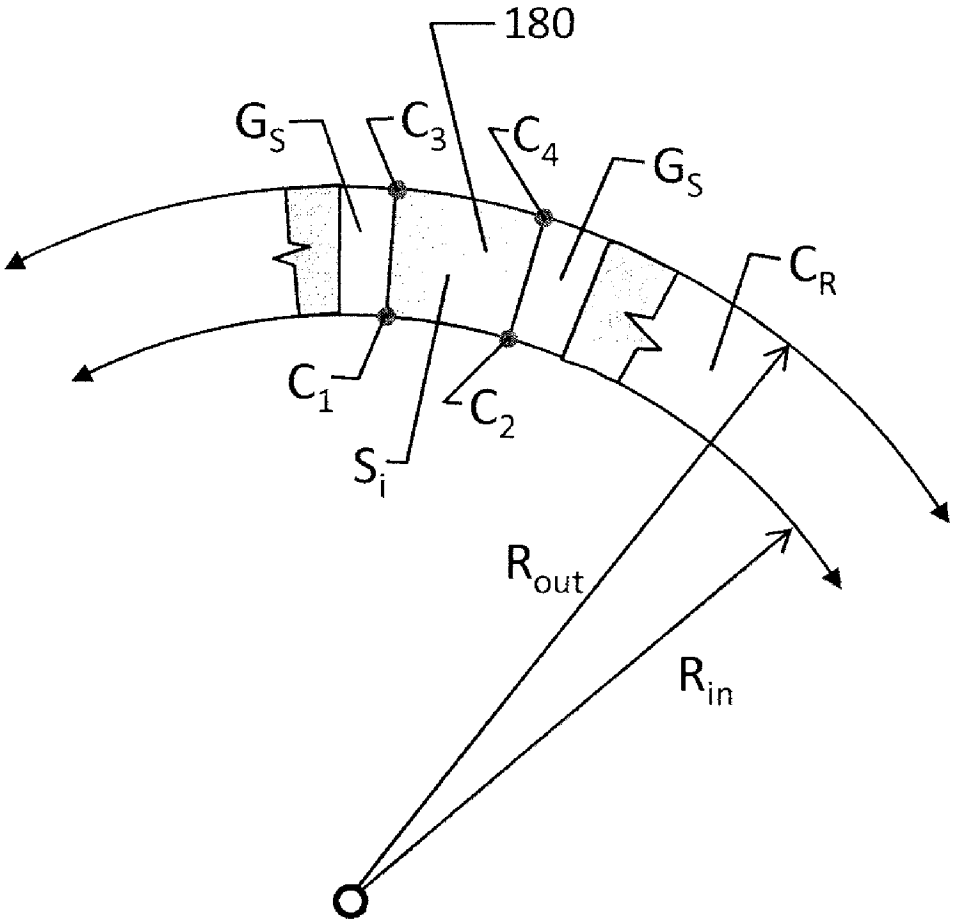
FIG. 4 is a view in cross section of a conductor in accord with an embodiment of the invention.
Figure 5:
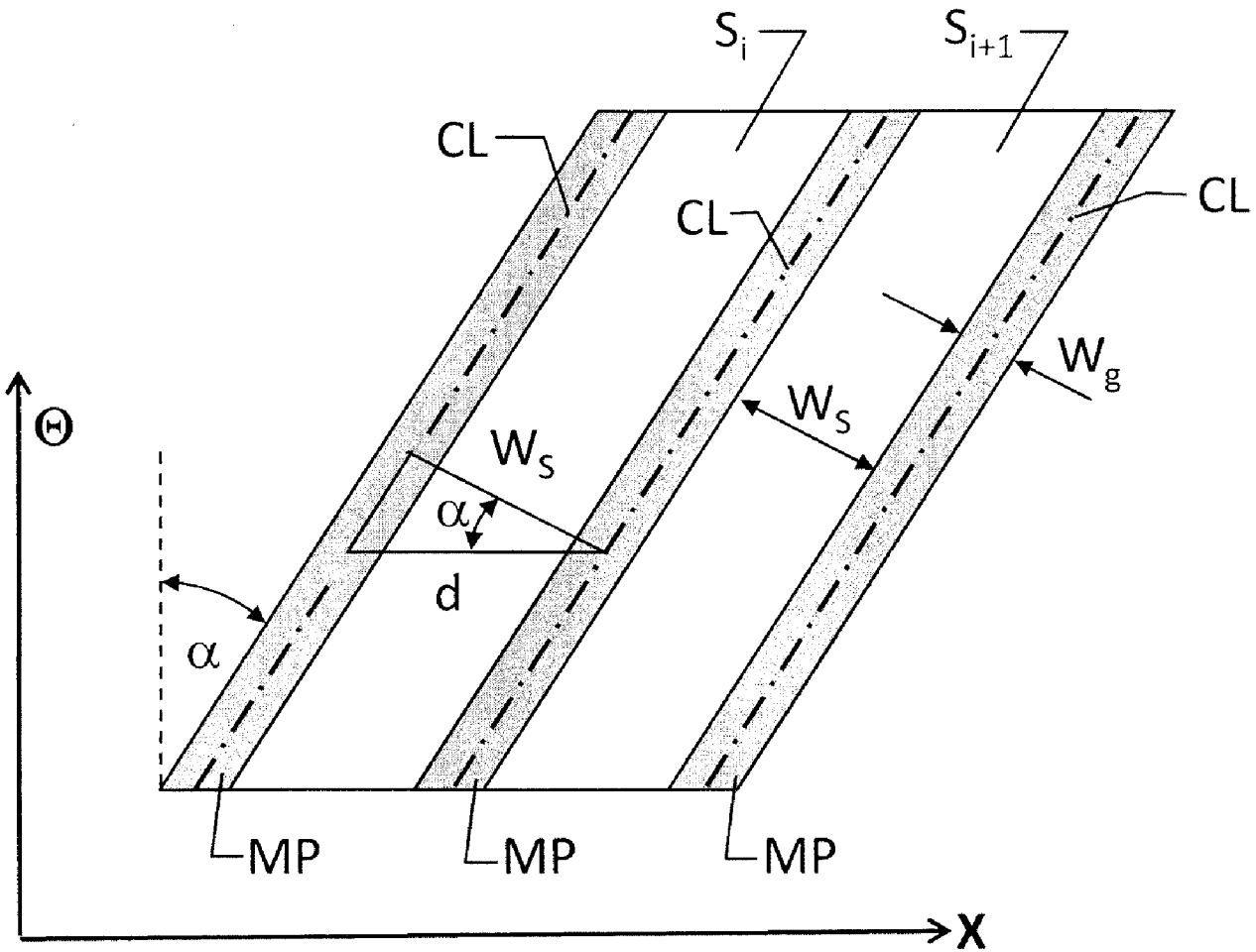
FIG. 5 is still another unrolled view of a conductor in accord with an embodiment of the invention.

Referring next to FIGS. 4 and 5, each strip, S, corresponding to one of the open, elliptical-shaped loops in an illustrated coil row, CR, may be described by 4 curves, $C_1$, $C_2$, $C_3$, $C_4$, each spatially positioned along one of the corners of a strip S. That is, assuming the strip has significant thickness, two of the curves, $C_1$, $C_2$, are located on an inner cylinder with radius $R_{in}$ and two of the curves $C_3$, $C_4$, are positioned on an outer cylinder with radius $R_{out}$. $R_{in}$ and $R_{out}$ define the inner and outer radii of the conductive layer and $R_{in}$ corresponds to the aperture radius, R. See FIG. 4 which provides a partial view of coil row CR in cross section, showing two adjacent groove spaces $G_S$ with a fashioned conductive strip, $S_i$, positioned between the groove spaces. Groove spaces $G_S$ shown in FIG. 4 are views in cross section of turns $T_i$ shown in FIG. 3.

According to one method for modeling the magnetic fields, the geometry of the four curves $C_1$, $C_2$, $C_3$, $C_4$, can be determined by subdividing the helical-shaped groove G, cut into the conductive cylinder, into individual elliptical-shaped groove turns, $T_i$, shown in FIG. 3 and labeled $T_1$ to $T_k$, each having a center path in accord with the space curve, i.e., the center line CL of the path MP for each of these curves is obtainable with Equation 1. See, also, FIG. 5.

Assuming that the router bit provides a circular cutting shape of diameter $D_{router}$ with a corresponding radius $R_{router}$, the strip corner curves are defined for the various strips, $S_i$ as follows:

| | | |
|---|---|---|
| Strip $S_1$: | left edge: | Turn-1 + $R_{router}$ |
| | right edge: | Turn-2 − $R_{router}$ |
| Strip $S_i$: | left edge: | Turn-2 + $R_{router}$ |
| | right edge: | Turn-3 − $R_{router}$ |
| . . . | | |
| Strip $S_n$ | left edge: | Turn-k + $R_{router}$ |
| | right edge: | Turn-k + 1 − $R_{router}$ |

The following procedure outlines a process for calculating points on each of the corner curve space paths. It is noted that with similar procedures, space paths can be calculated for still other, or additional, curves within the conductor strips $S_i$ to improve accuracy of the model, e.g, by positioning the additional curves to more accurately model the current density distribution in the conductor strips. The required current density distribution can be determined by a finite element analysis using Maxwell's equations. The displacement of points relative to individual points along the center of the tool path curve (Equation), to provide the corner curve paths, is determined as now described.

The slope angle at any point along the tool path curve in the unrolled view is given by the following derivative obtained from Equation 1, assuming a dipole field (n=1):

$$\frac{dX}{du} = \tan(\alpha) = \frac{h}{2\cdot\pi\cdot R} + \frac{A_1}{R}\cdot\cos\left(\frac{u}{R}\right) \quad \text{with: } u = R\cdot\theta \qquad \text{Equation 2}$$

where $R=R_{in}$ or $R_{out}$. From Equation 2 one obtains the slope angle α as a function of u or θ:

$$\alpha(\theta) = \tan^{-1}\left(\frac{h}{2\cdot\pi\cdot R} + \frac{A_1}{R}\cdot\cos\left(\frac{u}{R}\right)\right) = \tan^{-1}\left(\frac{h}{2\cdot\pi\cdot R} + \frac{A_1}{R}\cdot\cos(\theta)\right) \qquad \text{Equation 3}$$

The resulting displacement in the X-direction with a router radius of $R_{router}$ for any point along the tool path curve is then given by:

$$\Delta X(\theta) = \frac{R_{router}}{\cos(\alpha)} \qquad \text{Equation 4}$$

In this example based on four corner curves defining each conductor strip $S_i$, the field calculations of the coil are based on the same four corner curves $C_1$-$C_4$. With the tool path approximated by closely spaced points along the tool path curve, each of these points is then shifted to the right or left by ±ΔX(θ) to obtain the corresponding point on the strip corner curve. Applying the superposition principle for magnetic fields, the Biot-Savart Law, presented in Equation 5, is then used to calculate the field resulting from each of the four corner strip curves $$\overrightarrow{dB} = \frac{I \cdot \overrightarrow{dl} \times \overrightarrow{R_{test}}}{R_{test}^2} \quad \text{Equation 5}$$

where I is the current flowing in the filament, dl is the vector segment along the filament and $R_{test}$ is the vector from the filament section to the test point, where the field needs to be determined.

This relationship approximates the total field generated by elements within a strip, $S_i$, with the assumption that the current flowing in the strip is equally shared between the four corner curves (current carrying filaments) $C_1$-$C_4$. For very wide strips or thick strips in the radial direction more filaments can be distributed in the cross section of the conductive strips to obtain more accurate representations of the flowing current in the strip and more accurate field calculations. The actual current density distribution, which normally is not uniform, can be calculated with finite element methods.

Having determined how to calculate the field of a Direct Helix coil row, the winding pattern can be optimized according to various goals. With specification of high field uniformity, all higher-order multipole fields (quadrupole, sextupole, etc.) should be as small as possible, and an optimization can be performed as follows in which an objective function is determined, the function having a minimum when the optimization goal is found. For the requirement of vanishing higher-order multipole components, one can form the sum of all higher-order multipole components squared. This sum will have its minimum when the higher-order terms are vanishing. One can then modify the X(θ) function of Equation 1 in the following way to define a 3 dimensional space curve which describes the tool path along a centerline thereof. The centerline also corresponds to a centerline CL along the resulting groove, G:

$$X(\theta) = \frac{h}{2 \cdot \pi} \cdot \theta + A_1 \cdot \sin(\theta) + \sum_{n=2}^{nmax} \varepsilon_n \cdot \sin(n \cdot \theta + \phi_n) \quad \text{Equation 6}$$

Based on this tool path line a Direct Helix coil row can be generated and the field can be calculated. Using an optimization code like Simplex or evolutionary algorithms one can optimize the amplitudes $\in_n$ in such a way that the objective function approaches its minimum and the field meets the requirements of higher-order terms being as small as possible.

Figure 9:
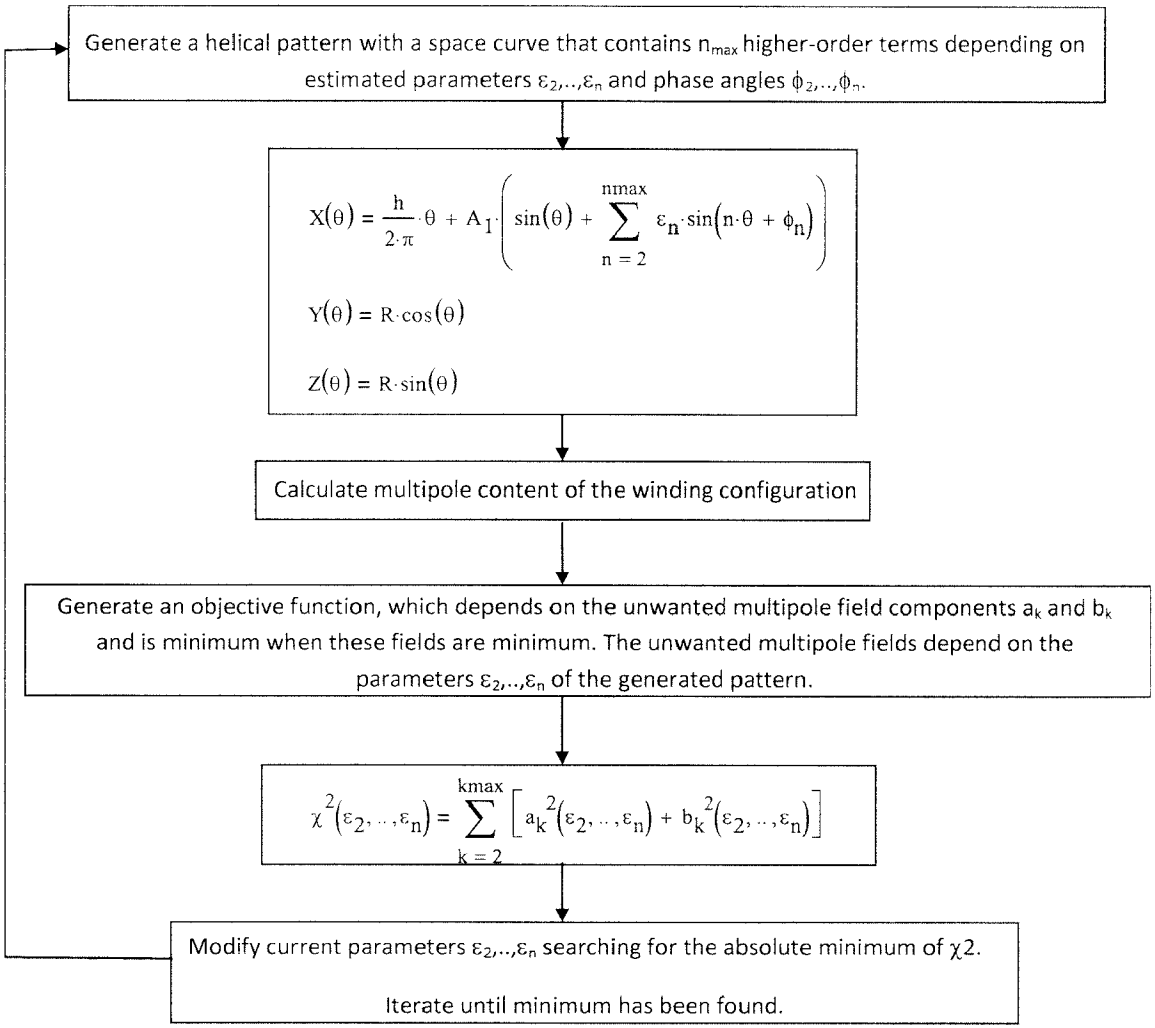
FIG. 9 is a flow chart illustrating an optimization procedure for minimization of unwanted multipole components.

In order to estimate the total resistance of a Direct Helix coil row, the variation of conductive strip width as a function of azimuth angle θ, as well as the current density distribution, has to be taken into account. To reduce manufacturing errors, e.g., random errors, a multipole measurement can be performed after fabrication of each Direct Helix coil row and identified errors can be offset by incorporating appropriate modulations in the space curve for the next outer coil row based on an optimization procedure similar to that described with reference to FIG. 9. The local width of the conductive strips as a function of azimuth angle θ can be calculated by determining distances between points along planes transverse to direction of the strip path. For the illustrated example this can be effected beginning with one pair of space curves ($C_1$, $C_2$) or ($C_3$, $C_4$) and first determining the distance d along the X-axis. The strip width $W_s$, measurable along a plane transverse to the path of the strip, is given by:

$$W_s = \frac{d}{\cos(\alpha)} \quad \text{Equation 7}$$

Unique features of the Direct Helix geometry enable conductive strips $S_i$ which provide a relatively low coil resistance not achievable with other coil designs. Direct Helix coils can also be configured into assemblies providing highly efficient conductor cooling configurations such that normal conducting Direct Helix coils can achieve fields that have not been achievable with conventional coil windings.

With in-situ "machining" to define the conductor, use of conductor materials, which would be impossible to configure with conventional winding techniques, becomes feasible. In particular, high temperature superconductors, which are brittle, can be applied to provide coils with unprecedented performance.

As shown in the partial unrolled view of a coil row shown in FIG. 3B, groove segments, "Line In-a", "Line Out-b", are machined, one at each end, to complete the coil pattern. With reference to the embodiment of FIG. 3B, the groove segments "Line In-a", "Line Out-b" each run alongside one of the groove segments "Line In-b" or "Line Out-a" to provide a "Lead-in connector" 102 and a Lead-out connector" 104, each extending inward from a different one of the two opposing ends 106, 108 of the coil row CR to meet and a first or last coil row strip $S_i$ or $S_k$. Thus the combination of groove segments "Line In-a, Line In-b" and "Line Out-a, Line Out-b" complete the formation of a "Lead-in connector 102 for bringing current into the coil row and a Lead-out connector 104 for taking current out from the coil row, e.g., to another coil row that has been machined in a concentrically positioned cylinder, as further illustrated in a partial view of an assembly 100 of coil rows CR shown in FIG. 6.

The coil row CR fabricated from the aluminum tube 10 was machined out of an aluminum cylinder having an inner diameter of 1.75" and a wall thickness of 0.125". The router bit diameter used in the machining process had a diameter of 0.0625". The helical groove, G, consists of 24 turns $T_i$. At both ends 106 and 108 the machined groove departs from the coil row pattern, continuing without interruption in an axial direction toward an end of the aluminum cylinder, to provide the connectors 102 and 104.

For many applications several Direct Helix coil rows or multiple pairs of direct double helix coil rows are arranged about one another, e.g., as concentric cylinders, as this may be necessary or desirable to create a Direct Helix coil assembly capable of generating a required field configuration. Again noting that the coil rows are not limited to regular geometric shapes, the partial view of an assembly 100 of coil rows CR shown in FIG. 6 is an example of such an assembly based on regular shaped cylinders formed into coil rows and arranged in a concentric configuration.

Figure 6:
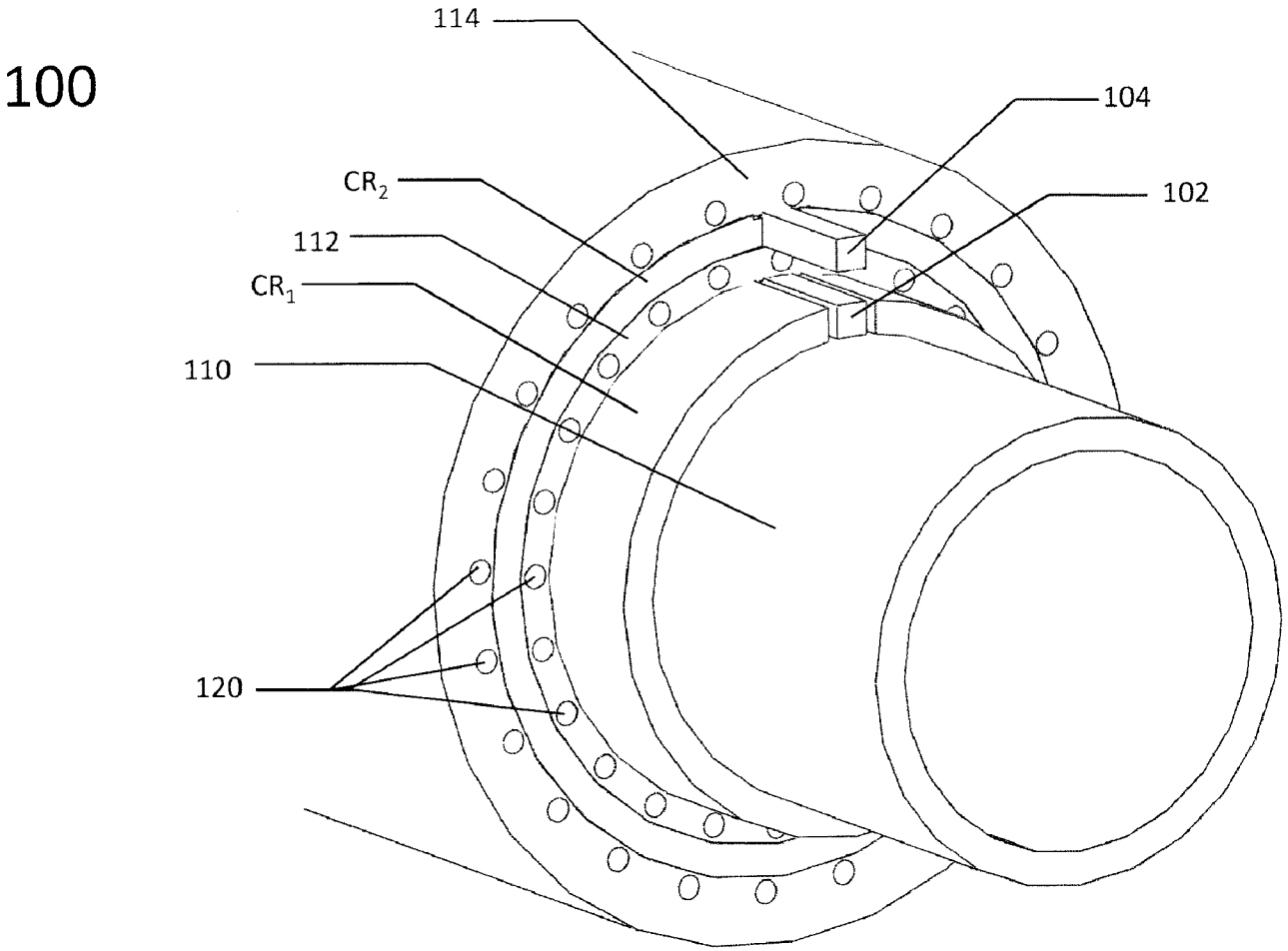
FIG. 6 is a partial view of an assembly formed with coil rows according to the embodiment of FIG. 2.

It is to be understood that FIG. 6 is a simplified illustration showing only one pair of coil rows $CR_1$ and $CR_2$ in the larger assembly 100 in order to more clearly describe features. The assembly 100 comprises a large plurality of such cylindrical-shaped coil rows $CR_i$ concentrically arranged and connected according to the invention. In this view, taken near an end of the assembly 100, the outer coil row $CR_2$ is concentrically positioned about the inner coil row $CR_1$. A lead-in connector 102 and a lead-out connector 104 such as shown in FIG. 3B and for the coil row of FIG. 2, are associated with each coil row $CR_i$.

With this arrangement the connectors extending at each end 106 and 108 from the different coil rows CR can be interconnected as shown for the two illustrated coil rows $CR_1$ and $CR_2$ to form a continuous winding pattern with multiple coil rows, e.g., formed as concentric cylinders. In this example, the lead-in connector 102 of coil row $CR_1$ is positioned for connection with the lead-out connector 104 of coil row $CR_2$. A small piece of conductive material (not shown) is soldered between the lead-in connector 102 of the coil row $CR_1$ and the lead-out connector 104 of the coil row $CR_2$ to make the current connection. The two other connectors (102, 104) each associated with a different one of the coil rows $CR_1$ and $CR_2$ at the other end of the assembly 100 (not shown in FIG. 6) then either serve as a lead-in or a lead-out connector to a different coil row (not shown) or form an input or an output lead for the entire assembly 100.

The coil row $CR_1$ of the assembly 100 is formed about a core 110 which may be an insulative layer formed on a stainless steel bore that defines an effective aperture for the assembly. In addition, an insulative spacer layer 112 is interposed between the coil rows $CR_1$ and $CR_2$ and may serve as a support core on which the coil row $CR_2$ is fabricated prior to insertion of the coil row $CR_1$ within the coil row $CR_2$. Another insulative spacer layer 114 is positioned about the coil row $CR_2$. As more fully described for the coil assembly 150 shown in FIG. 10, the assembly 100 includes a series of cooling regions (not shown) formed in conjunction with the insulative spacer layers 112 and 114. A series of entry or exit ports 120 for passage of liquid or gaseous coolant are formed along end portions of the spacer layers 112 and 114.

For a better understanding of the described field uniformity optimization a brief summary is presented of the multipole formalism used to describe transverse magnetic fields of coils like the Double Direct Helix. The magnetic field in a long straight section of a cylindrical-shaped helical configuration, generating a transverse field, can be considered as two dimensional and can be described in a cylindrical coordinate system in accord with the following harmonic expansion:

$$B_\theta(r,\theta) = B_{ref}\sum_{n=1}^{\infty}\left(\frac{r}{r_o}\right)^{n-1}\cdot(b_n\cdot\cos(n\cdot\theta)+a_n\cdot\sin(n\cdot\theta)) \qquad \text{Equation 8}$$

$$B_r(r,\theta) = B_{ref}\sum_{n=1}^{\infty}\left(\frac{r}{r_o}\right)^{n-1}\cdot[(b_n\cdot\sin(n\cdot\theta))-a_n\cdot\cos(n\cdot\theta)]$$

wherein $r_o$ is a reference radius, where the field is determined, and $B_{ref}$ is the magnitude of the main field at this radius. The coefficients $b_n$ and $a_n$ are dimensionless normal and skew multipole components. Using the transformation $$B_y(r,\theta)=B_r\cdot\cos(\theta)-B_\theta\cdot\sin(\theta)$$

$$B_z(r,\theta)=B_r\cdot\sin(\theta)+B_\theta\cdot\cos(\theta) \qquad \text{Equation 9}$$

the field can be described in Cartesian coordinates (X,Y,Z) with the coil axis along the X-direction, as $$B_y = B_{ref}\sum_{n=1}^{\infty}\left(\frac{r}{r_o}\right)^{n-1}\cdot[b_n\cdot\sin[(n-1)\cdot\theta]-a_n\cdot\cos[(n-1)\cdot\theta]] \qquad \text{Equation 10}$$

$$B_z = B_{ref}\sum_{n=1}^{\infty}\left(\frac{r}{r_o}\right)^{n-1}\cdot[b_n\cdot\cos[(n-1)\cdot\theta]+a_n\cdot\sin[(n-1)\cdot\theta]]$$

For an ideal "normal" dipole field $b_n$=1 and all other components $a_n$ and $b_n$ are zero. Using the above expressions the "normal" and "skew" dipole fields are obtained:

Equations 11:

Normal dipole field: $B_{ref}=B_1$ (B1 measured in Tesla)

$$B_\theta=B_1\cdot\cos(\theta)\ B_y=0$$

$$B_r=B_1\cdot\sin(\theta)\ B_z=B_1$$

Skew dipole field: $B_{ref}=B_1$:

$$B_\theta=B_1\cdot\sin(\theta)\ B_y=-B_1$$

$$B_r=B_1\cdot\cos(\theta)\ B_z=0$$

Normal quadrupole field: $B_{ref}=g*r_o$ (the gradient g is measured in Tesla/m)

$$B_\theta=g\cdot r\cdot\cos(2\cdot\theta)\ B_x=g\cdot y$$

$$B_r=g\cdot r\ \sin(2\cdot\theta)\ B_y=g\cdot x$$

Equations 11 also apply to the case of a normal quadrupole which is obtained for n=2. Although the harmonic expansion describes a two-dimensional field along an infinitely long axis, it is convenient to characterize magnets of limited length with the same harmonic expansion by applying this formalism at different positions along the axis.

As described above it is convenient for the computation of multipole fields to assume that the conductor path can be represented by an infinitely thin filament located at the center of the physical conductor, which in many instances may have a circular cross section. Shapes which are quadrilateral, oblong, etc., may be modeled as approximately rectangular or by composing a series of "sheets" or "ribbons" with filaments placed in the sheets to approximate the current density distribution in the conductor. For example, approximately rectangular-shaped conductors can be modeled by placing the thin filaments in the corners of a cross sectional shape of the conductor as described above, but more filaments can be placed inside the conductor cross sectional shape to model the current density distribution.

These three-dimensional space curves may be described as polygons, consisting of small straight filament sections. The end points (corners) of each polygon segment may coincide with the actual space curve, but other arrangements and additional filament sections may be incorporated. For a sufficiently large number of elements, a polygonal-based approximation can describe the space curve with a high degree of precision. By summing the field contributions from all polygonal segments in all of the loops along the 3-D space curve, a good approximation to the actual magnetic field at any point in space is obtained. The accuracy of this approximation increases with the number of segments that are used to describe the conductor. Thus, using the Biot-Savart Law (Equation 5), the magnetic field $B_\theta$ (Equation 7) is calculated for n points equally spaced along the azimuth of the reference circle (see FIG. 7).

Figure 7:
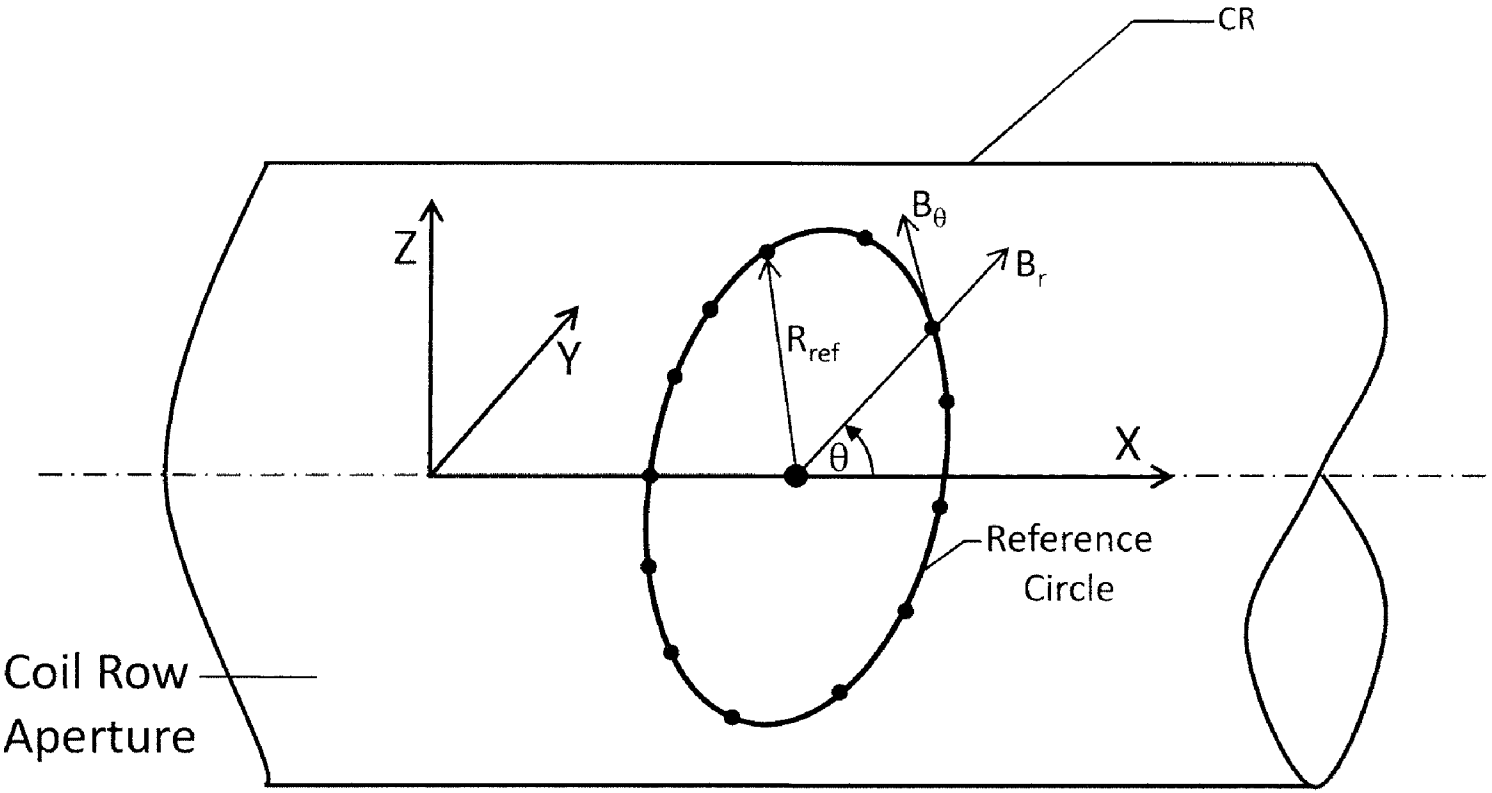
FIG. 7 illustrates a reference circle along a coil row aperture for calculation of a magnetic field.

Performing a Fourier analysis on these field values with appropriate normalization yields the multipole fields in Tesla (or Gauss) of the winding configuration represented by the current carrying filaments. The multipole fields can be calculated for various X-positions to fully describe the field of the coil. In the illustration of FIG. 7, a reference circle with radius $R_{ref}$ is positioned inside of a coil row CR in a plane transverse to the X axis, consisting of a set of filaments in the X-direction and crossing over on the right hand side. A set of points are indicated on the circle, where the field is calculated. At each of these points the field vectors $B_\theta$ and $B_r$ are calculated.

Based on the multipole calculations of a given coil configuration a field optimization (such as described herein) can be performed to eliminate unwanted multipole components. The flow chart of FIG. 9 describes this iterative process for the case of a dipole field that has unwanted higher-order multipole components.

Using well known optimization procedures like Simplex or evolutionary algorithms the parameters $\in_1, \ldots \in_n$ are modified in an iterative manner until the best solution is found. As shown in the flow chart of FIG. 9 an objective function is constructed for the optimization which approaches its minimum when the unwanted multipole components vanish.

In most cases an optimization as described is performed to generate coils with pure multipole fields, e.g. dipole, quadrupole, etc. However, another feature according to the invention is that double helix designs based on Direct Helix coil row configurations can also be used to generate "combined function" magnets, i.e., coils that simultaneously produce several multipole fields. In some applications this would be a superposition of dipole and quadrupole fields as often needed for charged particle beam optics. In order to generate combined function magnets an objective function is built, which reaches its minimum when the different required multipole fields approach their desired value. This is done by subtracting the desired values of the multipoles from the corresponding term in the objective function shown in FIG. 9. Other parametric optimizations can also be performed, such as for minimization of coil resistance or varying the relative strengths of different multipoles. The objective function can also perform optimizations to remove undesired multipole orders in designs wherein the coil rows are formed along curved or other non-linear axes (e.g., by providing bending transformations) such as described in U.S. application Ser. Nos. 12/133,645 and 12/133,721, both filed Jun. 5, 2008, assigned to the assignee of the present application and incorporated herein by reference.

In some embodiments, where only the field inside of the aperture is being used, it would be advantageous to surround the coil with a concentric iron cylinder of sufficient thickness to increase the field inside the aperture by 20-50%. Such an iron yoke will also significantly reduce the stray magnetic field on the outside of the coil structures.

Figure 10:
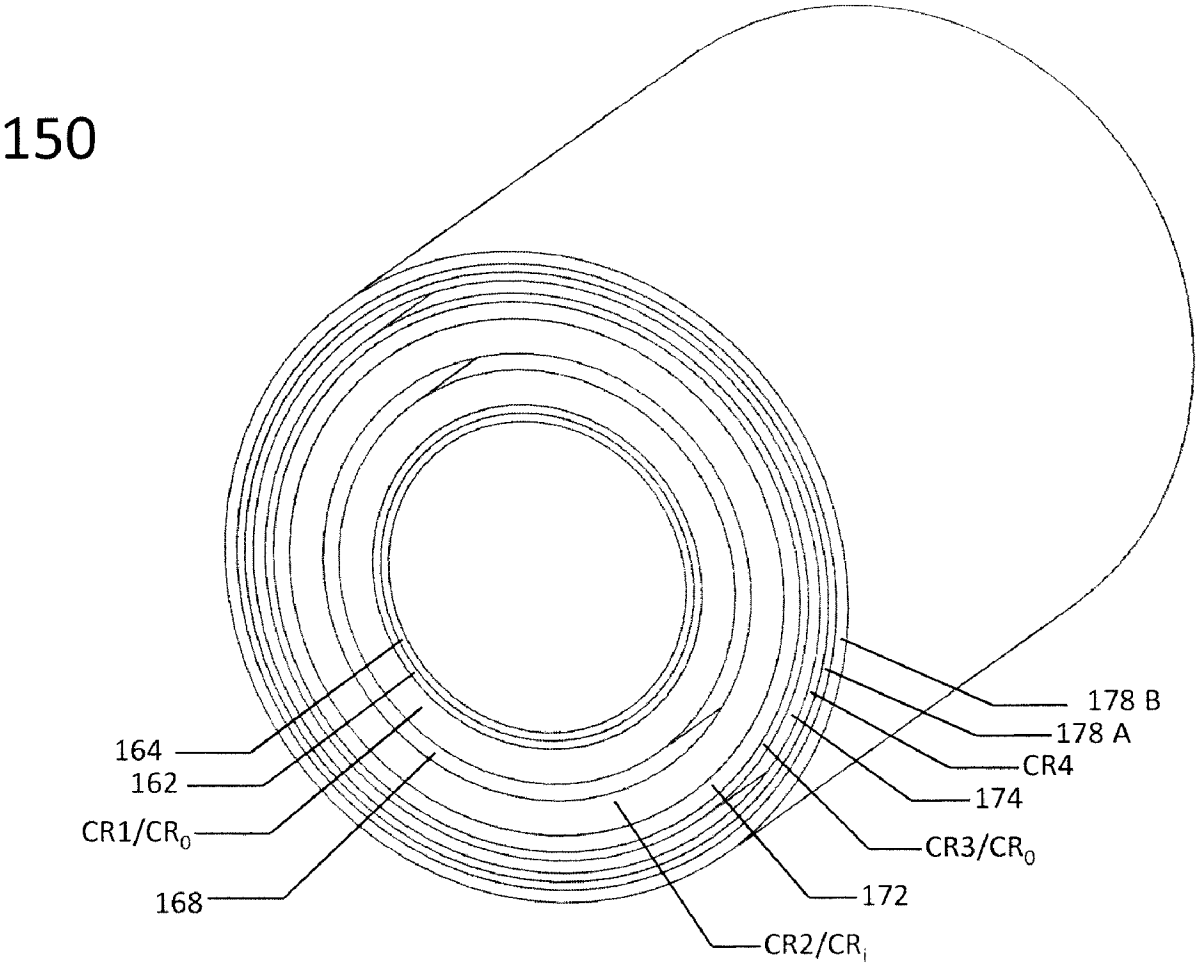
FIG. 10 is a perspective view in cross section of a coil assembly according to another embodiment of the invention.

The radial dimensions of a Direct Helix coil row assembly can result in a reduced assembly size relative to other designs in order to meet size or space limitations of a particular application without adversely affecting the transfer function of each coil row. The perspective view in cross section of a coil assembly 150 shown in FIG. 10 illustrates a sequence of concentrically aligned coil rows CR, including a pair of adjacent coil rows $CR_i$ and $CR_o$, consecutively positioned in the sequence. The coil row $CR_i$, referred to as an inner coil row, is concentrically positioned within the coil row $CR_o$, referred to as an outer coil row. The radial dimensions of the coil rows in the assembly can be varied relative to one another and can be reduced or minimized relative to corresponding dimensions in other helical coil designs. Reference to shapes and other features in cross section, in the context of conductor coil rows CR, refers to one or plural local cross sections based on a tangent vector for the conductor path along a space curve as already defined herein.

Generally, variations in radial dimensions, in combination with other local variations in conductor cross section, can effect a coil assembly of reduced size while still providing acceptable low coil resistance and field strength. According to numerous embodiments of the invention, cooling channels are provided for the coil rows wherein a cooling channel is provided for each coil row or wherein a single cooling channel is positioned to cool multiple coil rows. Also, the shape of the conductor, as viewed in cross section can be varied to achieve desired field quality or uniformity and to improve effectiveness of other features such as heat extraction.

In the example embodiment of the coil assembly 150, Cu may be selected as the conductor material because of its electrical and thermal properties, enabling relatively small radial dimensions for each coil row (e.g., $R_{out}-R_{in}$ is minimized). Depending on the chosen thickness ($R_{out}-R_{in}$), manufacture of the coil rows from copper or other relatively soft and malleable material requires that a degree of supplemental structural support be provided to the workpiece both during fabrication and afterward. This is true for the foregoing example of a relatively rigid, self-supporting coil row machined out of a hollow aluminum cylinder (e.g., the coil row of FIG. 2, formed from the aluminum tube 10, may be permanently mounted on a core or mandrel) having an inner diameter of 1.75 inches (4.44 cm) and a wall thickness of 0.125 inch (0.32 cm). Depending on the overall size and wall thickness of the tubular stock material (e.g., as measured in cross section for a quadrilateral, an ellipse or a cylindrical solid), such workpieces generally may not have necessary stiffness to undergo precision tooling of the coil row without provision of a support member.

An exemplary manufacturing process is now described which enables precision fabrication of such coil assemblies by assuring sufficient stiffness is imparted to the components during manufacture and after assembly. Although the process contemplates formation of coil rows by cutting grooves in a hollow body, it is to be understood that other techniques such as chemical plating and etching, or laser or electron beam removal, of soft metals like copper are contemplated. Nonetheless, such alternative processes can still require features of the process now described in order to assure precision manufacture.

The assembly of FIG. 10 comprises an inner-most support structure which, as shown, maybe an insulative layer 162 formed about a stainless steel bore 164 wherein the bore serves as an aperture for the coil 150. A first coil row CR1 is formed about the insulative layer 162. A second coil row CR2 is positioned in spaced-apart relation about the first coil row CR1 with a cooling region 168 between the two coil rows CR1 and CR2. An insulative layer 172 is formed about the coil row CR2 and a third coil row CR3 is formed thereabout. A fourth coil row CR4 is positioned in spaced-apart relation about the third coil row CR3 with a cooling region 174 between the two coil rows CR3 and CR4. An outer-most support structure 178 is formed about the coil row CR4 comprising, for example, an inner insulative layer 178A and a steel casing 178B enclosing the assembly 150.

The coil row CR2 corresponds to the coil row $CR_i$ and the coil row CR3 corresponds to the coil row $CR_o$ in the above-referenced pair of inner and outer coil rows, wherein coil row $CR_i$ is concentrically positioned within the coil row $CR_o$.

With reference to FIGS. 11A-11G, a fabrication sequence illustrated for the two exemplary coil rows CR2/$CR_i$ and CR3/$CR_o$ of the assembly 150 incorporates one or more mandrels or insulative layers that can provide multiple functions, including (i) imparting structural support and rigidity as the workpiece is fashioned as well as when the coil rows are brought together to form the assembly 150 and (ii) providing insulative or spacer features between coil rows of fully fabricated assemblies. In the illustrated fabrication sequence, formation of the coil row $CR_i$ is also illustrative of fabrication for the coil row CR1 based on positioning of a tubular-shaped core over the layer 162. The example illustrates coil rows CR having regular cylindrical shapes, with the fabrication sequence generally applicable to providing an insulative layer, e.g., layer 162, and a coil row, e.g., row CR1, formed about the insulative layer. However, the following process is directed to forming an assembly wherein a cooling channel, e.g., the region 168, is formed within a structure having inner and outer coil rows (e.g., the coil rows $CR_i$ and $CR_o$) with an intervening insulative support layer (e.g., the layer 172) between the inner and outer coil rows.

Figure 11A:
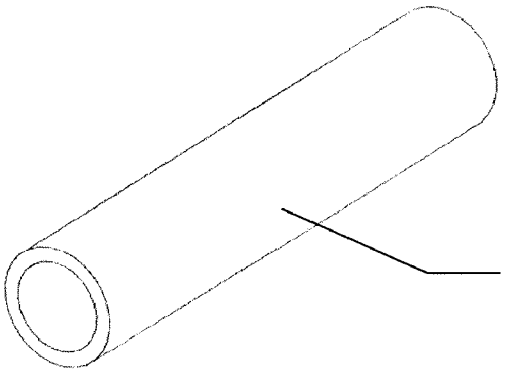
FIGS. 11A-11G illustrate a fabrication sequence for exemplary coil rows of the assembly shown in FIG. 10.
Figure 11B:
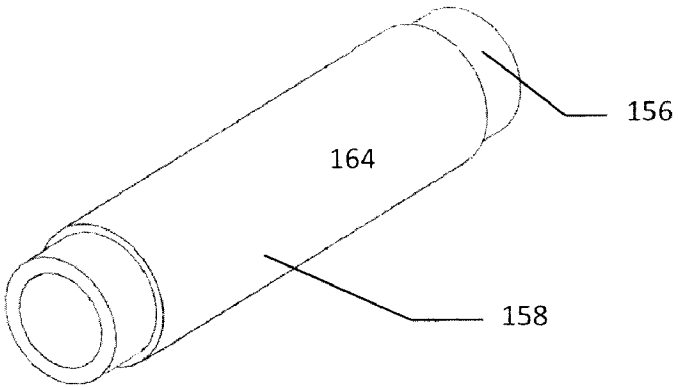

The process for fabricating the pair of coil rows $CR_i$ and $CR_o$ begins with provision of a first support structure shown in FIG. 11A, referred to as a mandrel 156, and a hollow tube-like core 158 shown with the mandrel in FIG. 11B. The mandrel is now described in a fabrication sequence in which it is removed, but it is to be understood that in an alternate process the mandrel may correspond to an insulative layer, such as the layer 162, wherein the mandrel is not removed after a coil row is formed from a core placed over the mandrel.

The exemplary core 158, the stock from which the inner coil row $CR_i$ is fabricated, is formed of copper in the shape of a regular cylinder. The core 158 has an aperture with an inner diameter corresponding to the aperture dimension of the coil row being fabricated, also referred to as $R_{in}$ as shown in FIG. 4. The removable mandrel 156 is a relatively rigid support tube, also cylindrical in shape, which is concentrically positioned and secured within the core 158 as shown in FIG. 11B. Per this embodiment, the mandrel 156 may be formed as a body separate from the core 158 and then slid inside the core, with the mandrel having an outer diameter, d, slightly smaller than the corresponding coil aperture dimension $R_{in}$ of the coil row $CR_i$ to effect a snug fit when the mandrel is slid inside of the core 158. If the mandrel is slid into the core, the interface between the mandrel 156 and the core 158 may be chemically bonded or otherwise stabilized so that the entire composite structure possesses sufficient structural stability to enable mechanical tooling of the core to create the coil row.

In another fabrication sequence (not illustrated), the arrangement of FIG. 11B may be had by forming the core 158 from a flat sheet which is wrapped about the mandrel 156, thereby conforming the sheet to the shape of the mandrel. In doing so, opposing ends of the sheet are brought together and seamed, e.g., by welding or another bonding technique, to form a continuous surface along the resulting cylindrical shape. The core may be further machined to specifications for uniformity before beginning the formation of a continuous groove, G, therein.

Figure 11C:
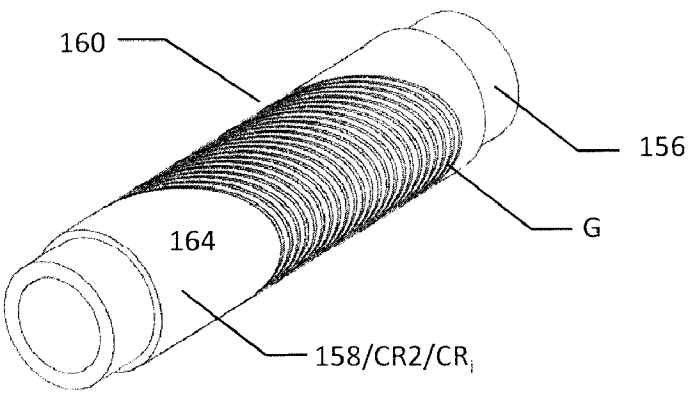
Figure 11D:
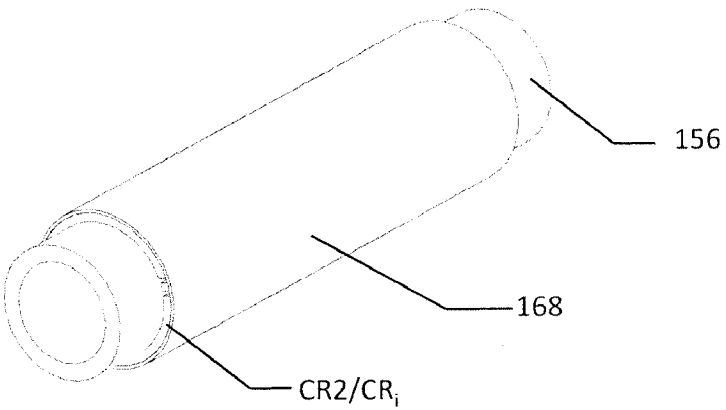

As shown in FIG. 11C, with the mandrel 156 in place to impart support and structural rigidity to the copper core 158, the groove, G, is cut through the surface 164 of the copper core to form a direct helix 160 of copper conductor. After machining of the groove is complete, a fiber-reinforced epoxy overwrap is applied to remaining portions of the surface 164 of the inner coil row. The overwrap is cured and machined to desired tolerances, resulting in an insulating layer 168 having a cylindrical shape of diameter slightly larger than the outside diameter, $R_{out}$, of the coil row CR3/$CR_o$. See, again, FIG. 4. The layer 168 also functions in part to stabilize the inner coil row $CR_i$ such that the mandrel is no longer required. Accordingly, the mandrel 156 is removed prior to fabrication of the outer coil row $CR_o$. See FIG. 11E.

Figure 11F:
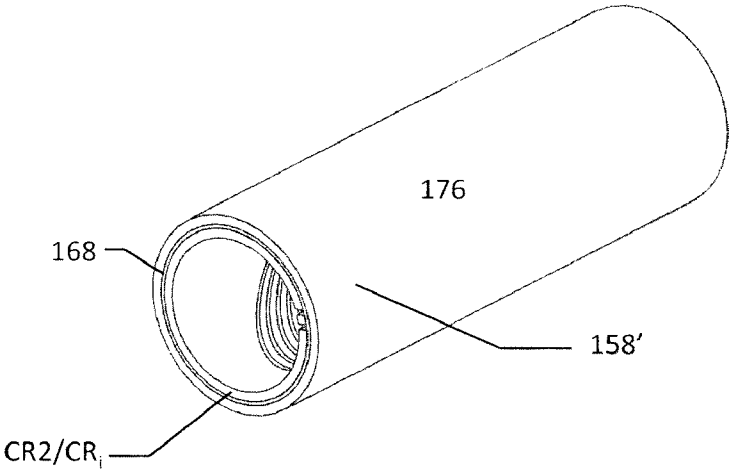
Figure 11E:
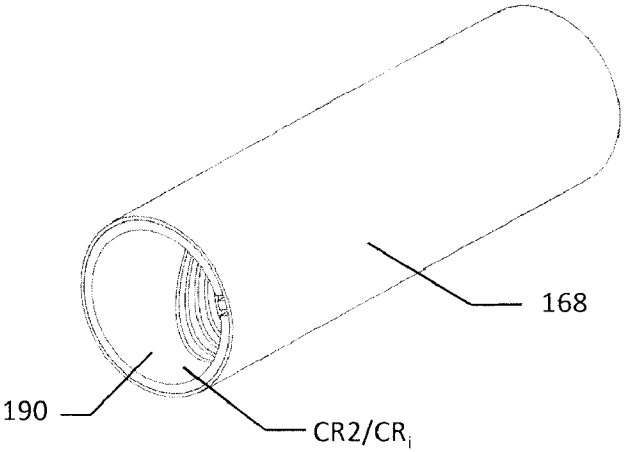
Figure 11G:
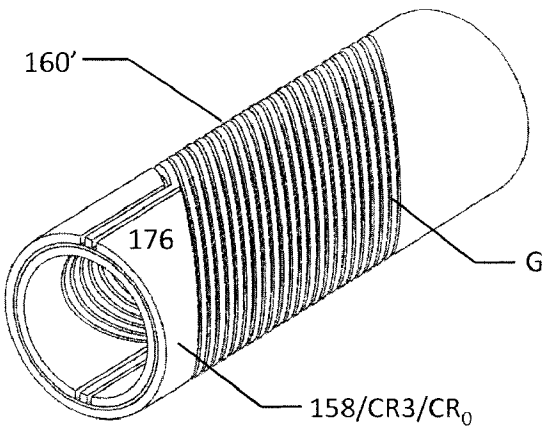

Next, the inner coil row $CR_i$ is slid into a second hollow tube-like core 158', which is also formed of copper in the shape of a regular cylinder as shown in FIG. 11F. The core 158' has an outer surface 176 and an inner diameter (corresponding to a radius $R_{in}$ as shown in FIG. 4) which is slightly larger than the outside diameter of the insulating layer 168. The inner coil row $CR_i$ is bonded or otherwise securely fastened to the inside surface of the core 158'. Bonding may be effected at the time that the composite structure of the coil row $CR_i$ and layer 168 is slid into the core 158', e.g., by first applying an epoxy-based resin over the layer 168 and/or over the inside surface of the core 158'. Other types of fastening, including formation of thermal bonds and use of mechanical means are suitable.

In the configuration of FIG. 11F the intervening layer 168 is positioned to electrically isolate the inner coil row $CR_i$ from the inside surface of the conductive core 158'. By bonding or otherwise fastening the inside surface of the core 158', i.e., along the inner diameter, to the layer 168, stability is imparted by the composite structure (i.e., the coil row $CR_i$ and the layer 168) to the core 158'. A groove, G, is cut through the surface 176 of the copper core 158' to form a direct helix 160' of copper conductor, resulting in the outer coil row $CR_o$ shown in FIG. 11G. The groove formation may be effected in various ways as discussed with respect to formation of the groove in the inner coil 152.

In this example the insulative layers 162 and 172 are a cured resin which results in a strong, fiber-reinforced epoxy overwrap which can be readily machined to tolerances which permit each coil row CR to fit within another coil row CR and thereby create the completed assembly 150 of concentrically placed coil rows CR. Although not illustrated, the assembly may include multiple additional pairs of so formed inner and outer coil rows $CR_i$ and $CR_o$. Once each member in a pair of the inner and outer coils $CR_i$ and $CR_o$ is formed or otherwise positioned in a concentric relation to an adjacent member of the same pair, the intervening insulative layer, e.g., layer 172, provides electrical isolation between two adjacent coil rows and assures structural integrity for both of the coil rows. See, again, FIG. 11. Different coil rows in the assembly 150 may be formed with similar or different groove configurations, and may have the same, opposite or otherwise varying tilt angles, as well as different conductor thickness ($R_{in}$–$R_{out}$ as indicated for one coil row in FIG. 4). Coil rows CR having the same or different values of n per Equation 1 may be assembled in a variety of sequences to create the coil assembly 150. Although the assembly has been described as comprising Cu coils, other materials are contemplated and different coil rows CR may be fabricated from different materials. Removal of the mandrel 156 may be effected by forming the mandrel of a commercially available material which can be dissolved or chemically removed, or the mandrel may be machined out.

An additional feature of the assembly 150 is that formation of coil rows as pairs, such as according to the configuration described in FIGS. 11A-11F, enables formation of a coil assembly as a sequence of concentric coil rows, including one or more coil row pairs $CR_i$, $CR_o$ wherein one surface of the conductor in each coil row, along $R_{in}$ or along $R_{out}$ is not covered with an insulative layer such as the layer 172. This can result in having conductor surfaces in each of the coil rows exposed to and in direct contact with a cooling region, e.g., the regions 168 and 174, through which a coolant like water, air or other cryogen can flow, thereby enabling very high current densities. Current densities exceeding 110 $A/mm^2$ have been demonstrated during continuous operation of such a coil assembly by flowing cold de-ionized water along exposed surfaces of conductor in the exposed direct helix coil rows CR. Evaluations have been performed with water at a temperature of 15 C and a flow rate across the coil rows of about 5 liters per second.

With variations in conductor width, e.g., as shown in FIG. 3, heat generated in each coil row is effectively conducted from relatively narrow portions to wider portions of the conductor, where larger surface area effects a greater rate of heat transfer to the coolant. Noting that the illustrated conductor is in the form of a quadrilateral having one side positioned against an insulative layer like layer 172, the coolant can enter the grooves between loops of the coil row conductor to effect heat exchange on all three of the other conductor sides. This increased rate of heat exchange further enhances current carrying capability of the coil rows CR. The high current densities demonstrated with the described direct helix coil row designs have not been achieved with other technologies using normal conducting material at room temperature under continuous excitation. The high current density is enabled, in part, by high efficiency cooling of the coil rows CR for the assembly 150 of FIG. 10. The high cooling efficiency results from direct contact between conductor material in the coil rows and the coolant, e.g., water. Furthermore, with heat conducted from the narrow sections of the conductor to the wider sections, the larger surface area effects better heat transfer between the conductor and the coolant. In some embodiments of the direct helix technology the coolant can even penetrate into the grooves between adjacent conductors and thereby surrounding the heat generating conductor along three of the four sides. Further improvements in heat transfer and current carrying capability can result from graphene as the conductive layer in direct helix coils. This is the strongest material known to mankind and at the same time offers exceptionally high electrical and heat conductivity.

As illustrated in the view of FIG. 10, the assembly 150 comprises one pair of adjacent coil rows $CR_i$, $CR_o$. An insulative layer 168 positioned between the two coil rows $CR_i$ and $CR_o$ provides electrical isolation between, and structural support for, the two adjacent coil rows. Among individual pairs the thickness of conductor ($R_{out}$–$R_{in}$) may differ for $CR_i$ and $CR_o$.

Figure 12:
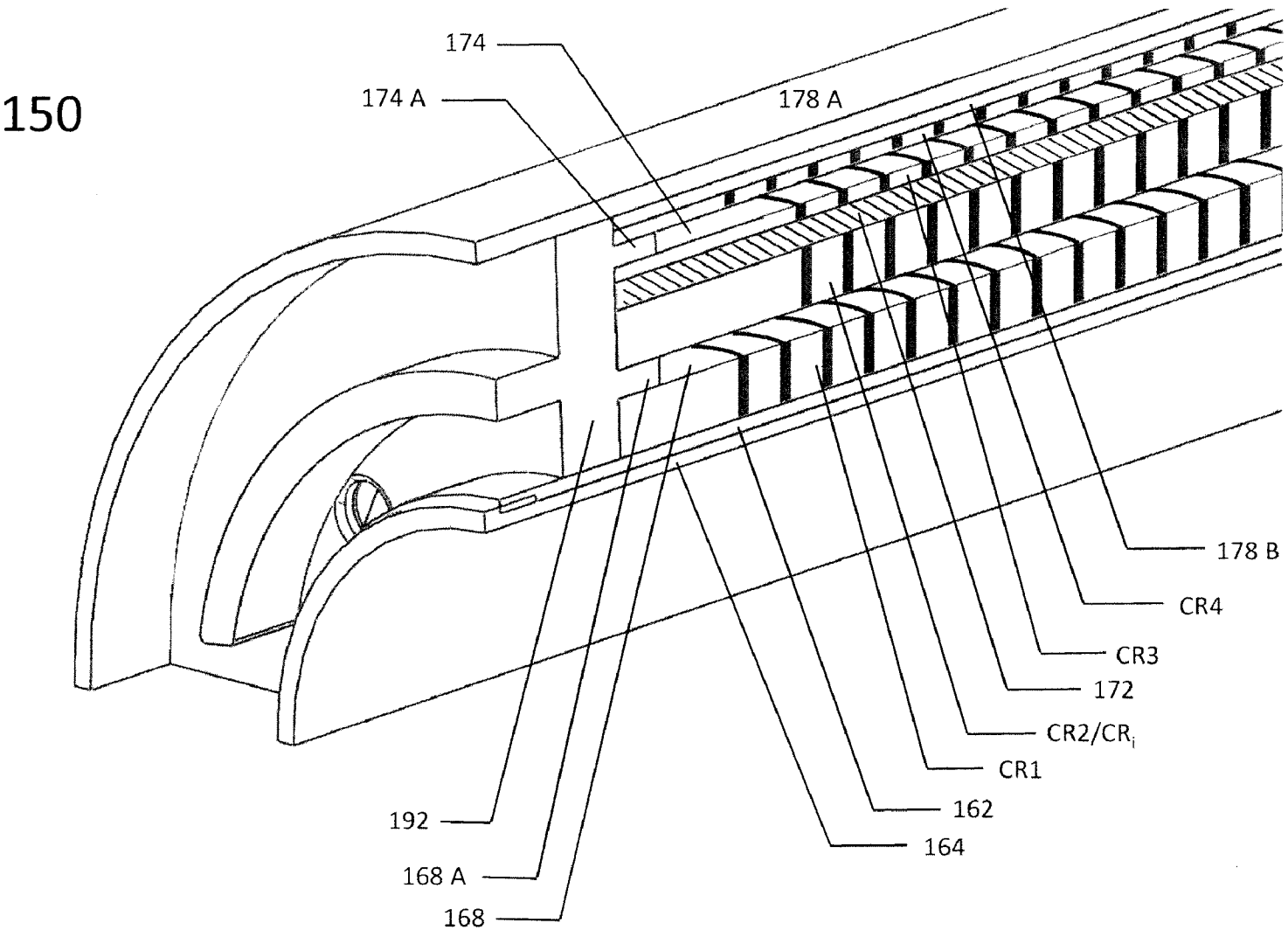
FIG. 12 is a partial isometric view of the assembly shown in FIG. 10 in a cross section taken along a central axis of symmetry.

FIG. 12 is a partial isometric view of the assembly 150 in a cross section taken along a central axis of symmetry, illustrating the position of the ring-shaped cooling region 168 along the inside surface 190 (see FIG. 11E) of the inner coil row CR2/$CR_i$. The partial view of the assembly 150 shown in FIG. 12 further illustrates positioning of an exemplary cooling region 174 between a coil row CR3 (corresponding to an outer coil row CR, in one pair of coil rows $CR_i$ (CR2), $CR_o$ (CR3), and another coil row CR4 concentrically formed or placed about the coil row CR2. The assembly 150 includes an alignment ring 192 at each end which provides for stable insertion of the several coil rows and insulation layers. The illustrated ring includes projections 168A and 174A each terminating in a space corresponding, respectively, to one of the cooling regions 168 and 174. An exemplary intake 194 to a manifold (not shown) receives or emits cooling fluid which flows through the cooling regions 168 and 174. By way of example, such a manifold may be connected to a series of entry or exit ports for passage of liquid or gaseous coolant as illustrated with the ports 120 in the assembly 100 of FIG. 6.

Figure 8:
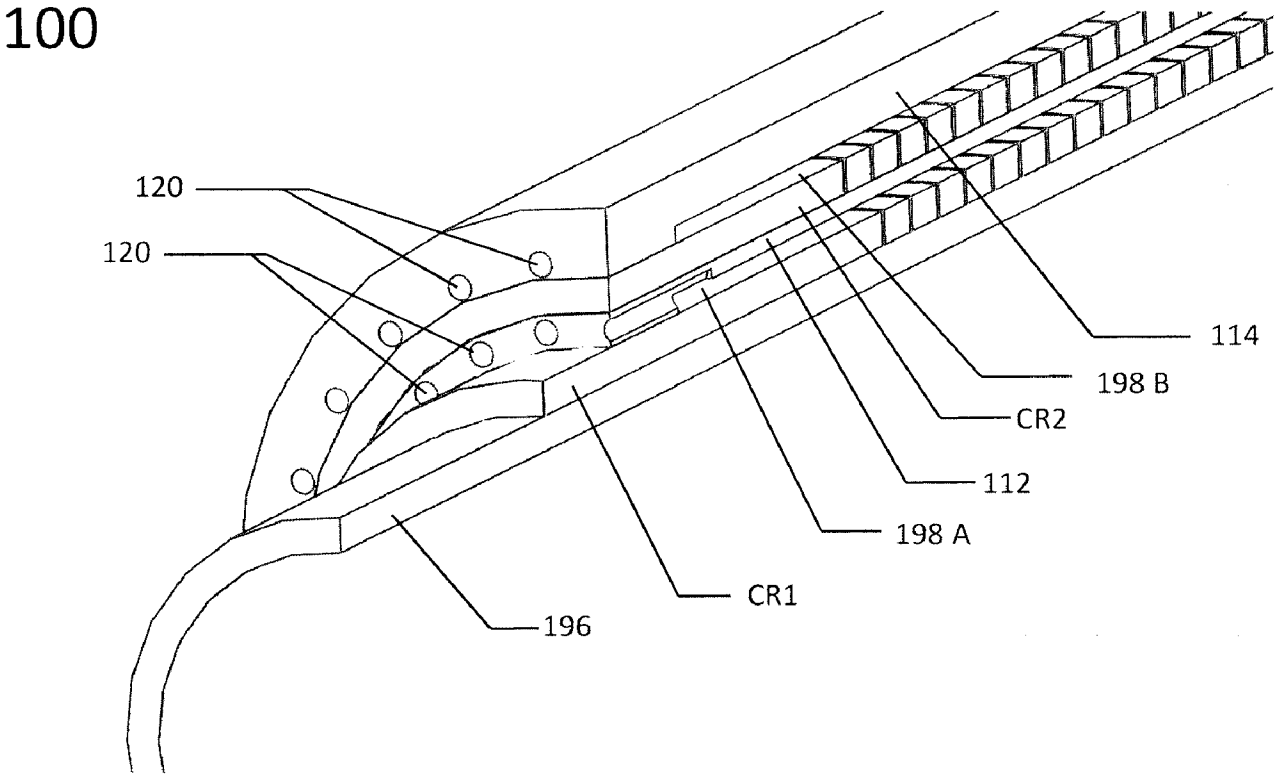
FIG. 8 provides a partial isometric view of the assembly of FIG. 6 in a cross section taken along a central axis of symmetry.

FIG. 8 is a partial view in cross section of the assembly 100 of FIG. 6, taken along a central axis through the aperture. The figure illustrates an exemplary configuration which provides cooling to coil rows CR1 and CR2. The structure comprises an outer manifold 114 which defines a gap with respect to the outer coil row CR2, creating a region 198B for flow of coolant entering or exiting through ports 120. Similarly, an insulative layer 112 is configured to define a gap with respect to the inner coil CR1, creating a region 198A for flow of coolant entering or exiting through ports 120. An insulative or support layer 196 is positioned along an inner surface of the coil row CR1. In this example there is a cooling region for each coil row whereas for the assembly 150 one cooling region may flow over two coil rows. With wiring assemblies fabricated as direct helix coils it becomes possible to generate coil rows having conductors of customized size and shape in cross section, i.e., as viewed in planes transverse to the direction along which the conductor extends. As described for the wiring assembly 150 of FIG. 10, the thickness of the conductor ($R_{out}$–$R_{in}$, as shown in FIG. 4) is determined by the thickness of the core material, e.g., the wall thickness of a cylindrical shaped core. More generally, the size, and shape of the conductor can be varied to minimize resistance or improve field uniformity. As illustrated in FIG. 3 for an exemplary dipole configuration (n=1), the conductive strips, S, of a Direct Helix coil change in width, $W_s$, with azimuth angle around the coil axis. The variable increases in strip width (relative to a minimum value) lead to a reduction in overall coil resistivity for a winding that produces transverse magnetic fields relative to the same winding made with a conventional wire conductor having constant area in cross section. For each coil row the transverse field is generated by the current component in the coil row conductor which points in the axial direction. However, each coil turn $T_i$ includes segments that are approximately perpendicular to the coil axis which produce axial magnetic fields. The number of these segments and their relative increase in width depends on the multipole order, n. The axial fields can be canceled for generation of a pure transverse field by incorporation of a second coil row having equal and opposite amplitudes, $A_n$, and current flow. The increased strip width, $W_s$, of the segments that produce axial fields leads to an overall decrease in resistivity.

Figure 13:
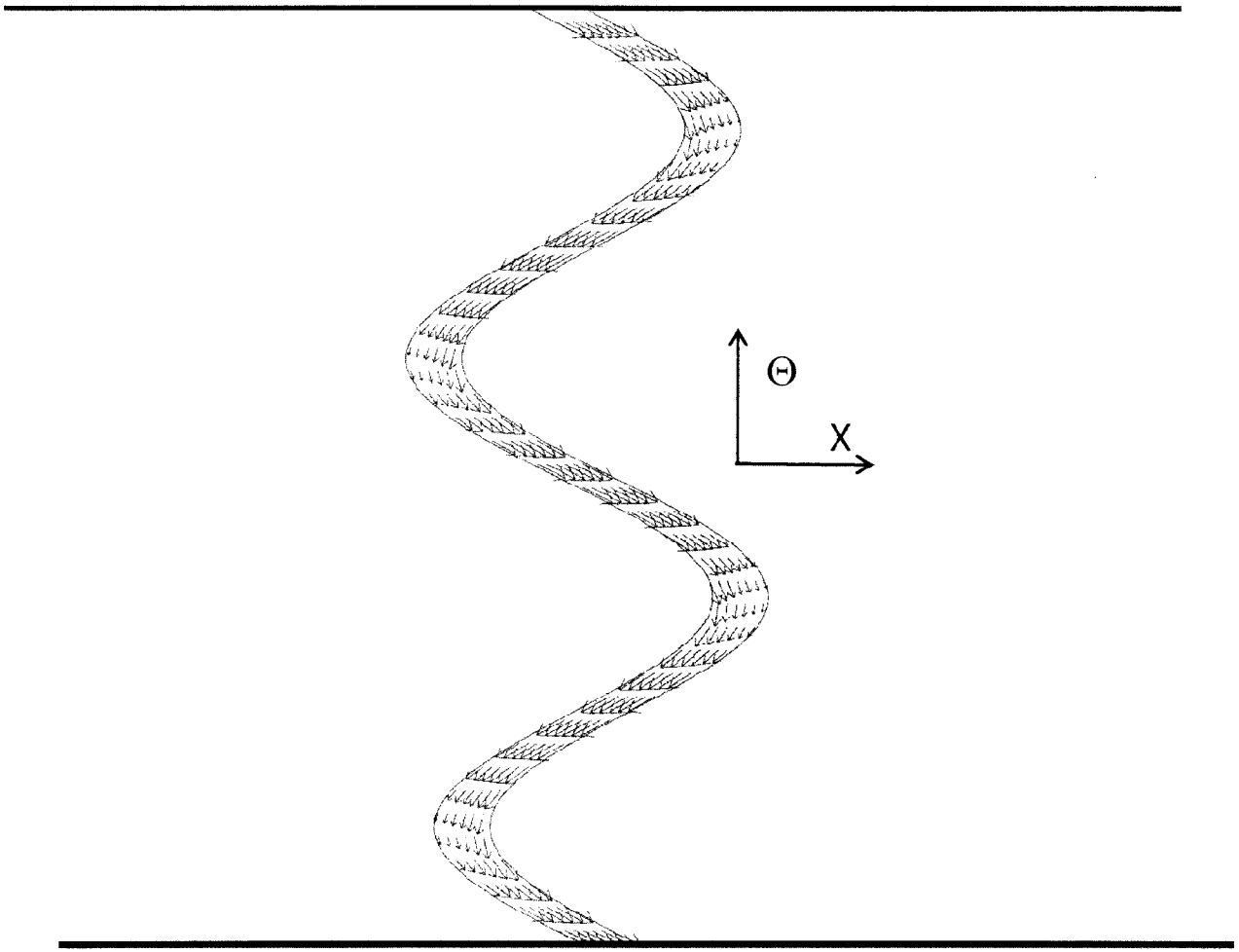
FIG. 13 is an unrolled view of a conductor portion illustrating variations in current density.

The resistivity of individual segments within a coil turn $T_i$ is a function of several variables, including size and shape of local strip cross sections, specific conductivity, and the electrical potential distribution along the strip. In most cases, the potential is not isotropic over the cross section. Simply stated, the flow of electrons will follow the path of lowest resistance. As the path of a strip S bends in accord with the three dimensional space curve, the electrons will preferentially follow the shortest possible path in the strip to get from one terminal to the other. The part of a coil turn, $T_i$, where the transition occurs from the tilted section that produces the transverse field to the wider strip section that produces the axial field corresponds to a local change in conductor direction with the electrons preferentially following the shortest possible path. This effect leads to a non-uniform current density distribution in these sections of the conductor. The effect can be modeled with finite element calculations that solve Maxwell's equations. Such a distribution is shown in the unrolled view of FIG. 13 for a strip S (corresponding to one loop) of a quadrupole (n=2) coil row. The distribution of current density throughout is indicated by the size of arrows. As can be seen from the illustration, sections of the strip having relatively small radii of curvature are characterized by a non-uniform current distribution with larger arrows indicating higher current densities and smaller arrows indicating lower current densities.

Given the variable bending radius of the strips, S, along the space curve, the Direct Helix technology enables local control of current distribution. While the strip width changes in accord with the tool path described in Equation 1, also of importance is the ability to vary the shape and thickness of the conductive strip in cross section. That is, the strip width can be machined to any desired width by making multiple tool paths as is common practice in many automated machining operations. The strip thickness can be adjusted along the cross section to render the current distribution at given conductor strip locations more uniform. For example, at a given position along a strip, S, where the current density is high, because the conduction electrons are seeking the shortest path along a bend, one can reduce the strip thickness, thereby forcing the current to spread out.

Figure 14C:
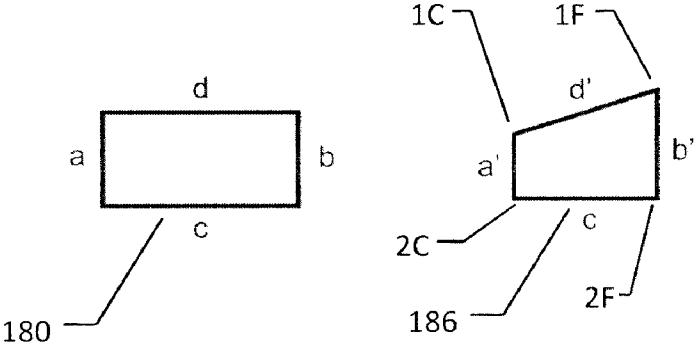
FIGS. 14A-14D illustrate variations in shape of conductor portions in cross sectional views.
Figure 14D:
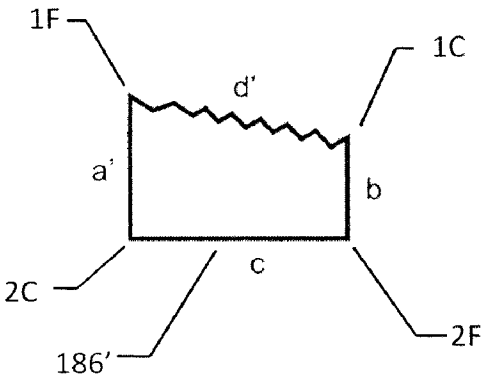
Figure 14A:
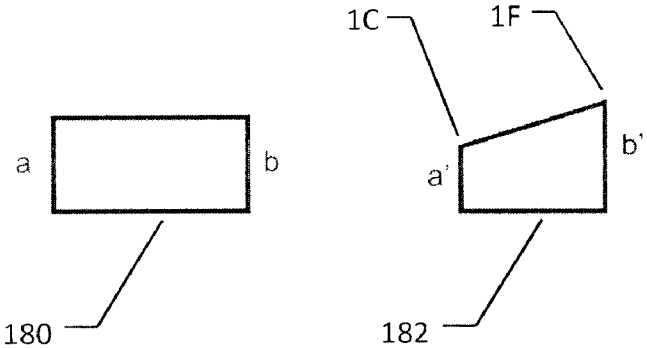

A first exemplary modification of the conductor shape in cross section, to render the current density more uniform across the conductor, is schematically shown in FIG. 14A, which compares the approximately rectangular shape 180 in cross section (see FIG. 4), with a trapezoidal shape 182, wherein a relatively large side a of the shape 180 corresponds to a smaller side a' of the shape 182, and a relatively small side b of the shape 180 corresponds to a relatively larger side b' of the shape 182. Assuming that current crowding occurs along side a of shape 180, e.g., due to a small bending radius of curvature, a decrease in area along the crowded region adjoining side a (effected by reducing the length of the side as indicated by side a' of shape 182) and an increase in area in other portions of the shape can modify the current density to achieve a more uniform distribution. The shape 182 can also effect lower resistivity during conduction.

Figure 14B:
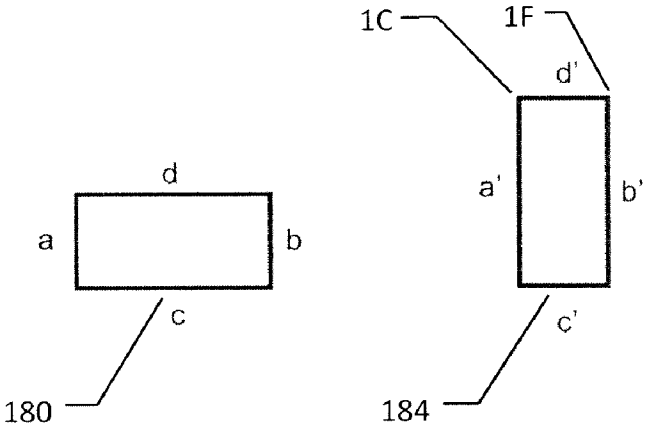

Next, referring to FIG. 14B, transition from the approximately rectangular shape 180 in cross section to a relatively narrow and tall shape 184 can effect a reduction in operational resistance. In this example, the dimensions of the upper and lower surfaces, c and d, are reduced to substantially smaller widths c' and d' while both sides are increased from lengths a and b to lengths a' and b'.

FIG. 14C illustrates another geometry to reduce current crowding along side a of the shape 180, effected by increasing the length of side a to that shown as side a' in shape 186 while not modifying the length of side b or lower surface c. Another feature of transitioning to the shape 186 is that when the upper surface is positioned along a cooling region for heat exchange, a significant increase relative to the length d will increase the area along the upper surface of the conductor along which heat exchange occurs and thereby increase the rate of heat exchange.

Also, recalling that the shapes 182, 184 and 186 can be effected with multiple passes of a cutting tool, another feature, shown in FIG. 14D, is the formation of surface details, e.g., small grooves, g, along the upper surface of the shape 186 as shown for the shape 186'. The small grooves may also facilitate greater surface interaction through, for example, turbulence, to further increase the rate of heat exchange. Generally, modifications to conductor shapes in cross section can provide larger amounts of surface area for heat exchange. It is also noted, to the extent a desired shape reduces resistance, but degrades field uniformity, that field optimization techniques such as described in conjunction with the discussion of the flow chart of FIG. 9, can offset these by introduction of modulations which cancel undesired components. The Direct Helix technology offers flexibilities in adjusting resistance and magnetic field shape and field uniformity that do not exist in other technologies.

Based on the above description it will be apparent that the invention provides a conductor assembly of the type which, when conducting current, generates a magnetic field or which, in the presence of a changing magnetic field, induces a voltage, comprising, wherein a conductor is positioned along a path of variable direction relative to a reference axis, in accord with $$X(\theta)=[h/(2*\pi)]\theta\pm\Sigma A_n f_1(n\theta)$$

$$Y(\theta)=Rf_2(\theta)$$

$$Z(\theta)=Rf_3(\theta).$$

The conductor, as formed in accord with the Direct Helix design, will have first and second opposing conductor surface regions, e.g., upper and lower surfaces of a quadrilateral shape, each extending different distances R from the reference axis (e.g., the X-axis) so that, at positions along the conductor path, portions of the first conductor surface region extend farther away from the reference axis than portions of the second conductor surface region. Generally, the conductor is characterized at each of multiple different path positions by a cross sectional shape along a plane orthogonal to the path direction, wherein the multiple cross sectional shapes vary among different path positions (e.g., based on azimuthal angle). Per the examples provided in FIGS. 14A and 14C, the first surface region (e.g., d') along each cross sectional shape may have a closest position 1C to the reference axis characterized by a distance $R_{1C}$ and a farthest position 1F characterized by a distance $R_{1F}$ farthest from the reference axis. The distances $R_{1C}$ and $R_{1F}$ correspond to measurement of $R_{in}$ shown in FIG. 4. The second surface region has along each cross sectional shape a closest position 2C characterized by a distance $R_{2C}$ closest to the reference axis and a farthest position 2F characterized by a distance $R_{2F}$ farthest from the reference axis. The distances $R_{2C}$ and $R_{2F}$ correspond to measurement of $R_{out}$ shown in FIG. 4. The distances $R_{1C}$ and $R_{1F}$ as shown in FIGS. 14A-14D may be equal or different. The distances $R_{2C}$ and $R_{2F}$ as shown in FIGS. 14A-14D may be equal or different.

The conductor may be further characterized by third and fourth opposing conductor surface regions (e.g., a' and b' of FIGS. 14A and 14B), each extending between the first and second opposing conductor surface regions. The cross sectional shapes along the planes orthogonal to the path direction may vary as follows:

A. the distance between third and fourth conductor surface regions may vary as a function of θ.

B. one or more of the distances $R_{1C}$, $R_{1F}$, $R_{2C}$ and $R_{2F}$ may vary as a function of θ, imparting a variable slope along the first conductor surface region or along the second conductor surface region as a function of position (or of θ).

The first, second, third and fourth surface regions may form a quadrilateral shape with sides defined by the points 1C, 1F, 2C and 2F, and the dimension of the third or fourth surface region may vary as a function of position along the path.

Figure 15:
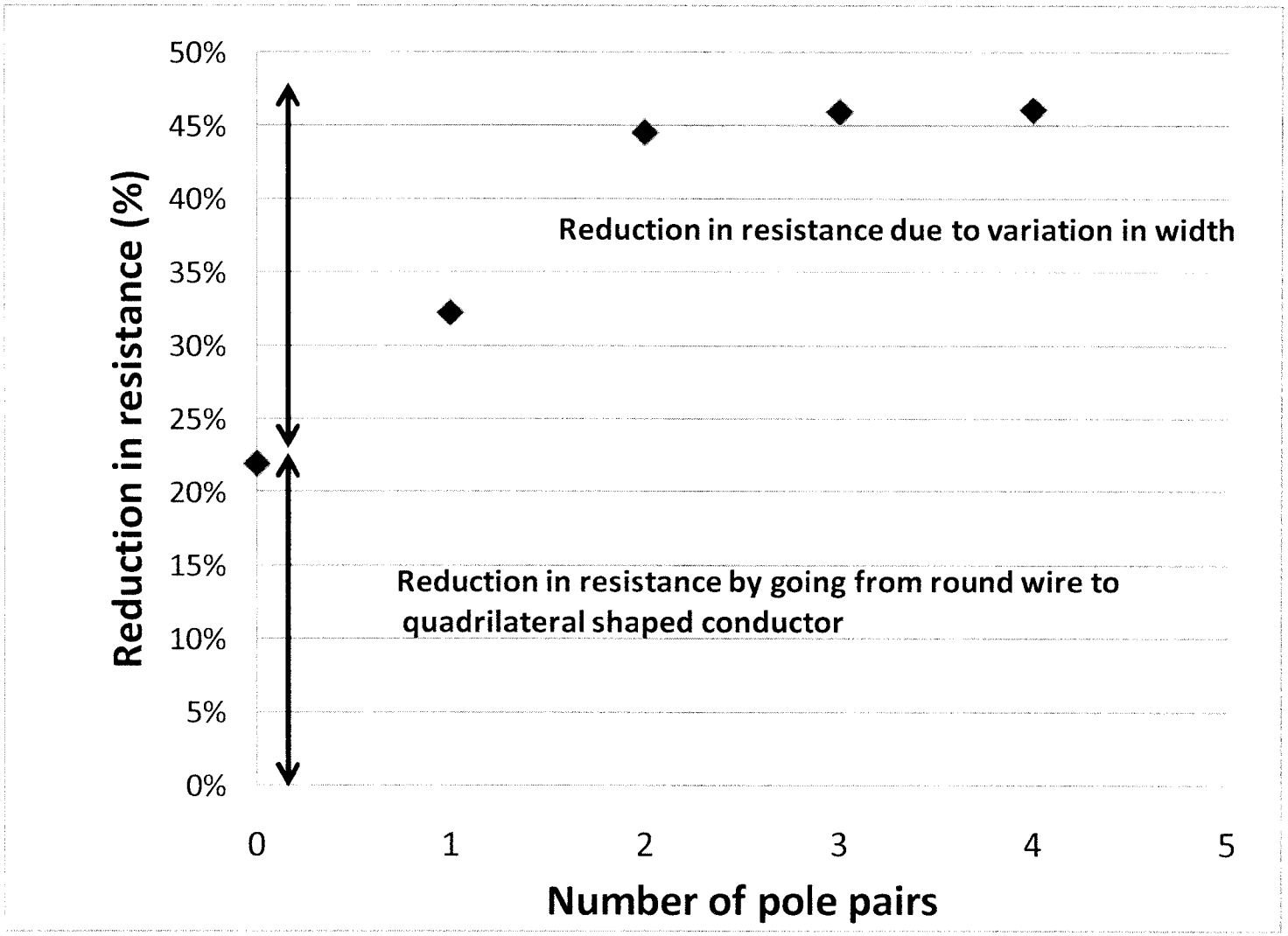
FIG. 15 illustrates reduction in magnet resistance realized in embodiments of the invention.

As noted, a feature of the Direct Helix design is that the spacing or groove width $W_g$ can be kept constant while the width of the conductor (as viewed in cross section) changes in accord with the tool path described in Equation 1. The graph of FIG. 15 illustrates the gain based on reduction in magnet resistance realized in embodiments of the invention wherein the conductor shape is of a quadrilateral shape (generally referred to as "square" although shapes shown in FIGS. 4 and 14 are contemplated) and the width varies as a function of azimuth angle. Improvements in conductivity on the order of 45 percent or more can be realized.

While the above discussion has concerned changes in cross sectional shape and size of conductor along the path of a coil row, features of the Direct Helix technology also relate to applications of transverse fields wherein different levels of field strength are desired in vertical and horizontal directions. For example, applications of dipole magnets for charged particle beam optics may require beam steering in both vertical and horizontal directions. This is achieved by using two concentric dipole magnets, whose field directions are rotated by 90 degrees relative to each other. In most of these cases the field of one magnet points in the vertical direction, enabling beam steering in the horizontal plane while the field of the second magnet points in the horizontal direction, enabling beam steering in the vertical plane. The current direction in both magnets can normally be reversed, which allows changes between up and down for the vertical steering and left and right for the horizontal steering.

For the exemplary assembly 150 of FIG. 10, a steering range in the horizontal direction is four times larger than the steering range in the vertical direction. In order to effect such a 4:1 ratio the field strength in the horizontal direction is four times larger than the field strength in the vertical direction. Assuming that the transfer functions, i.e., field strength per unit of current, of the coil rows CR3 and CR4 are approximately equal to the transfer functions of the coil rows CR1 and CR2, a larger magnet excitation current is needed for the horizontal steering. For a given conductor material of a magnet and its cooling scheme, current density in the conductor is limited, i.e., a maximum amount of power, given by the product of magnet resistance times current squared, can be accommodated without overheating the magnet coil. In the example shown in FIG. 10, the conductor thickness ($R_{out}-R_{in}$) in the coil rows CR1 and CR2 is four times larger than for the coil rows CR3 and CR4 in order to sustain the 4:1 field strength ratio and effect the greater steering range in the vertical direction. The larger conductor thickness of the coil rows CR3 and CR4 enables a significantly reduced resistance in the coil rows CR1 and CR2 and therefore a reduced power consumption for a given current. Accordingly, a larger current can be tolerated in the magnet with the thicker conductors of coil rows CR1 and CR2 before any overheating occurs.

Another feature of Direct Helix designs relates to an improved transfer function determinative of the achievable field strength per unit of excitation current through a coil row, measured in units of Tesla per Ampere. As with simple solenoid coils the field strength per unit of current increases for direct helix coils with the number of turns that are fit in a given coil volume. Increasing the number of turns in a given volume by reducing the conductor cross section limits the amount of current that can flow through the conductor. That is, the smaller the conductor, the smaller the current that can be carried without overheating. On the other hand, the number of turns per unit volume can also be increased by reducing the spacing between adjacent conductors in a coil row, such spacing determined by the machined groove width $W_g$ (see FIG. 3B) according to which the direct helix coil row is formed. The significance of reducing $W_g$ is evidenced from a design study for a quadrupole magnet in which, for a given current, a reduction of the groove width from 0.5 mm to 0.1 mm increased the number of turns per unit distance along the coil axis and thereby increased the quadrupole gradient by about 70% as shown in Table 1.

TABLE 1

| Groove Width [mm] | Quadrupole Gradient [Tesla/m] |
|---|---|
| 0.5 | 11.3 |
| 0.3 | 14.1 |
| 0.2 | 16.2 |
| 0.1 | 19.0 |

In a conventional machining process, e.g., using a rotating router bit, the groove width, $W_g$, is determined by the diameter of the router bit, and it becomes increasingly difficult to machine grooves with router bits of less than 0.5 mm diameter, in particular, if the depth of the groove is several times the tool diameter, as desirable for many coils fabricated with direct helix technology. However, the smaller groove widths shown in Table 1, down to 0.1 mm, can be readily achieved with other machining technologies like laser cutting, EDM, or etching. Photolithographic techniques may be combined with physical or chemical etch technology which exhibits a directional preference for material removal, e.g., in the radial direction.

The direct helix technology can provide improved performance to a number of systems applications. With regard to electrical machinery, rotors of generators and motors will benefit from the intrinsic robustness of the described coil rows. This is of particular importance for machines operating at high RPM. Furthermore, electrical machines can benefit from the unprecedented efficiency of the conductor cooling.

This enables much higher excitation currents, which increases the flux density in the rotor stator gap and significantly increases the power density of such devices. The use of aluminum as a conductor material would significantly reduce the weight of a rotor, with obvious advantages. The lower conductivity of aluminum in comparison to copper could be compensated by using low temperature coolants.

The disclosed invention provides advantageous beam steering and focusing systems as needed for charged particle radiation therapy, ion beam implantation and high energy particle accelerators. Use of the Direct Helix concept can also result in improved high field quality (i.e., pure and very uniform dipole or higher-order multipole fields). Other applications can provide high quality high field strengths without using superconductors. For example, high purity aluminum coil rows formed as described herein, and cooled with liquid nitrogen, will provide magnetic field strengths which have only been attainable in conventional wire wound coil systems with more complex and expensive superconducting devices. Applications that require rapidly changing high fields are difficult and, at high frequencies, impossible, to achieve with superconducting devices. The presented technology enables such systems which may employ efficiently cooled normal conductors. Specific examples of applications utilizing direct helix coil rows are now further described.

In the field of medical device applications, the Direct Helix design can be applied to form very small coils capable of generating high magnetic fields suitable, for example, in medical applications such as catheters and sensors, which may be inserted and steered through blood vessels. The scale of such devices can be even smaller, providing utility in MEMS applications as well.

In the field of non-destructive inspection techniques, applicable to complex technical systems and cargo, devices require charged particle accelerators with beam optics, which as mentioned above would benefit from the application of the presented invention. With the above described designs, smaller, more portable systems are enabled which can permit use of inspection techniques in critical applications including airport security.

Magnetic separation, the removal of unwanted components from water and other liquids can be applied to environmental clean-up, purification and other technical processes. With direct helix technology coil rows can be easily stacked up to form arrays of many coils, which in some embodiments have parallel axes. Such arrangements have the advantage that the unavoidable external field of any subunit enhances the field strength of its surrounding neighboring coils. The devices therefore are more efficient than single individual magnets. Furthermore, these coils can be inexpensively mass produced and stacked up to almost any required dimension. Although example embodiments have been described, numerous other designs and methods of manufacture are contemplated. For example, the aforedescribed cylinders in which helical grooves are formed may have an outer insulative surface (such as an anodization, a deposited coating or other material) under which the conductive layer resides. The insulative surface may be formed prior to or after the groove is formed in the shape.

Figure 16:
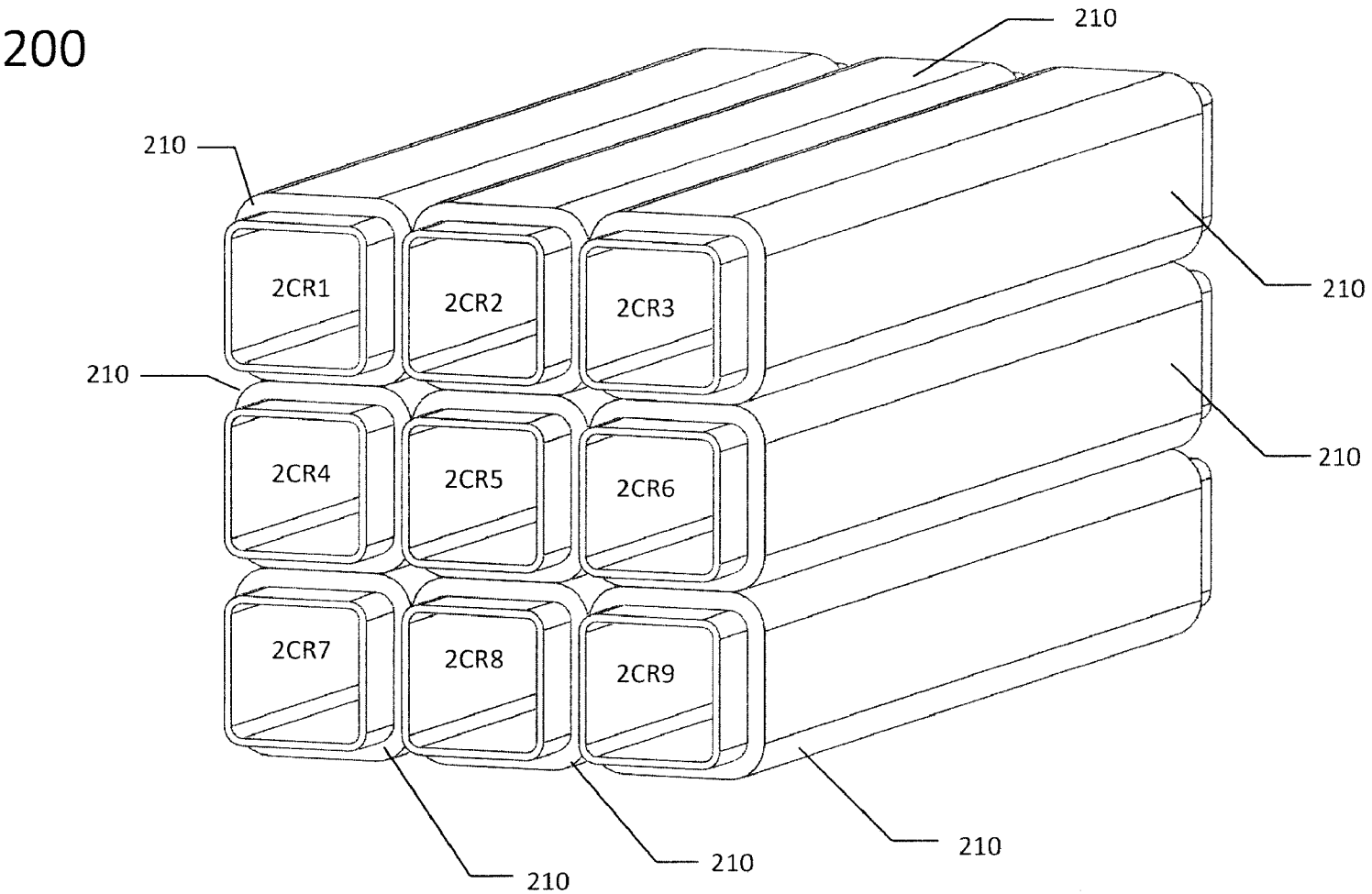
FIG. 16 illustrates an assembly of coil rows according to the invention which are suitable for separation of impurities.

For example, a number of technical processes require relatively strong magnetic fields over large volumes. In a magnetic separation process impurities are diverted from flowing water or gas streams with the application of large magnetic fields, based on paramagnetic or diamagnetic properties of the impurities. Paramagnetic particles, having intrinsic magnetic moments, accumulate toward regions of high field strength, and diamagnetic particles will drift towards regions of low field strength. In these applications of magnetic fields, field uniformity is of lesser concern, while robustness of the magnet system, volume of the magnetic field, and field strength are of greater importance. Large transverse magnetic fields are required in order to divert the impurities from the flow stream. In such a system, pairs of coil rows 2CR are formed in accord with direct helix technology, stacked like bundles of straws to form magnetic arrays as illustrated for the assembly 200 in FIG. 16, which provides a view in cross section through an exemplary array of nine pairs of Direct Double Helix (DDH) quadrupole coil rows 2CR. The pairs of coil rows 2CR are arranged with all of their axes parallel to one another. Each pair of coil rows CR is configured as a double helix wherein the axial field is canceled and the coil pair predominately generates a transverse field. The coil rows are sufficiently close to one another that external fringe fields of coils enhance the fields within the apertures of neighboring coils.

The size of such an assembly 200 can be scaled based on an increase in the number of coil rows, rather than the aperture size of the coil rows. Very large volume arrays of coil rows can be assembled based on mass production of relatively simple coils each fabricated as a direct helix. The strong fields achievable with direct helix coils enables application of a separation technology without use of superconducting coils. The array assembly 200 is not limited to forming arrays with coil rows that are circular coil cross section, Square and other stackable shapes enable formation of arrays with very little dead space between coil rows. For example, direct helix coils for such an application can be machined out of simple extruded box-shaped aluminum tubes.

Actuators are commonly used to effect mechanical action using electrical energy. The conversion can be done using conventional electrical machine configurations, but system integration may require linear motion or very limited motion that is better suited to linear configurations. In an attempt to reduce the greenhouse gas emissions from transportation systems, and to improve overall system efficiency and reliability, a conversion from hydraulic-based systems to electrical systems is required. Applications include aircraft and automotive actuators.

Direct Double Helix (DDH) technologies (i.e., a Double Helix design implemented with Direct Helix coil rows as described with respect to FIGS. 2 through 12) can be applied to build actuators in multiple ways. A DDH configuration may be used to form the armature which generates the acting field and a DDH configuration can also be used for the mobile component to generate the excitation flux. The configuration can be considered with or without an iron core or yoke depending on the application requirements. In another embodiment, the DDH configuration can be applied in the acting part (armature) with permanent magnets used for the excitation component. This configuration can also be done with or without iron core/yoke depending on the application requirements DDH magnets can be designed to create pure transverse fields, pure axial fields or a combination of the two with any number of poles. Incorporation of this feature in actuators can provide azimuthal stability during actuation. Actuation can be effected by ramping up of the power in the acting component leading to motion of the excited part to a minimum magnetic energy state or continuous transition between axial and transverse field.

Figure 17:
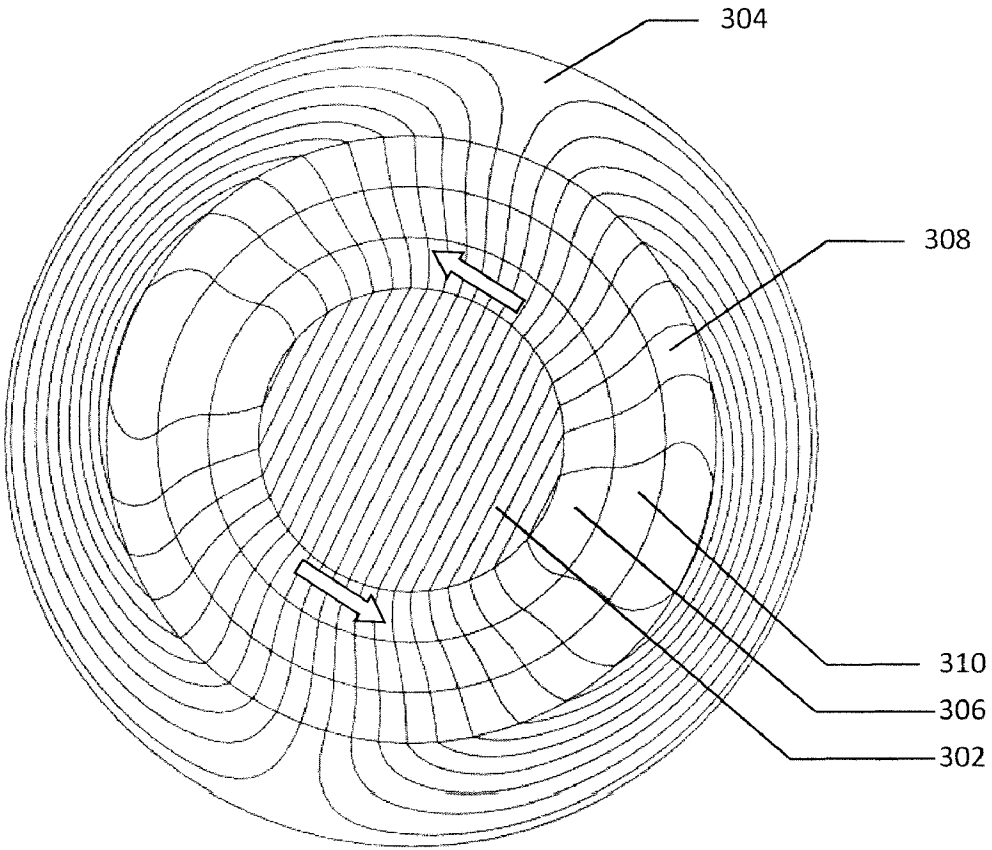
FIG. 17 is a view in cross section of a transverse field actuator incorporating features of the invention.
Figure 18:
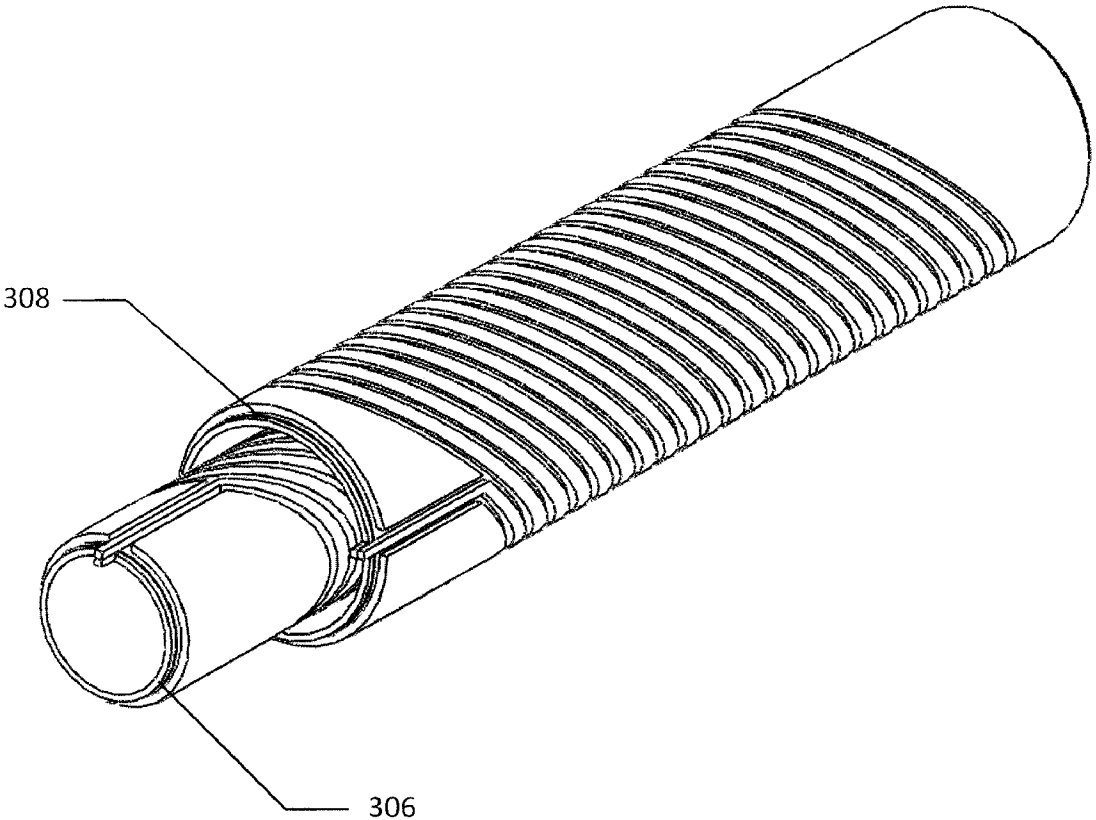
FIG. 18 provides an isometric view of the actuator shown in FIG. 17.
Figure 19:
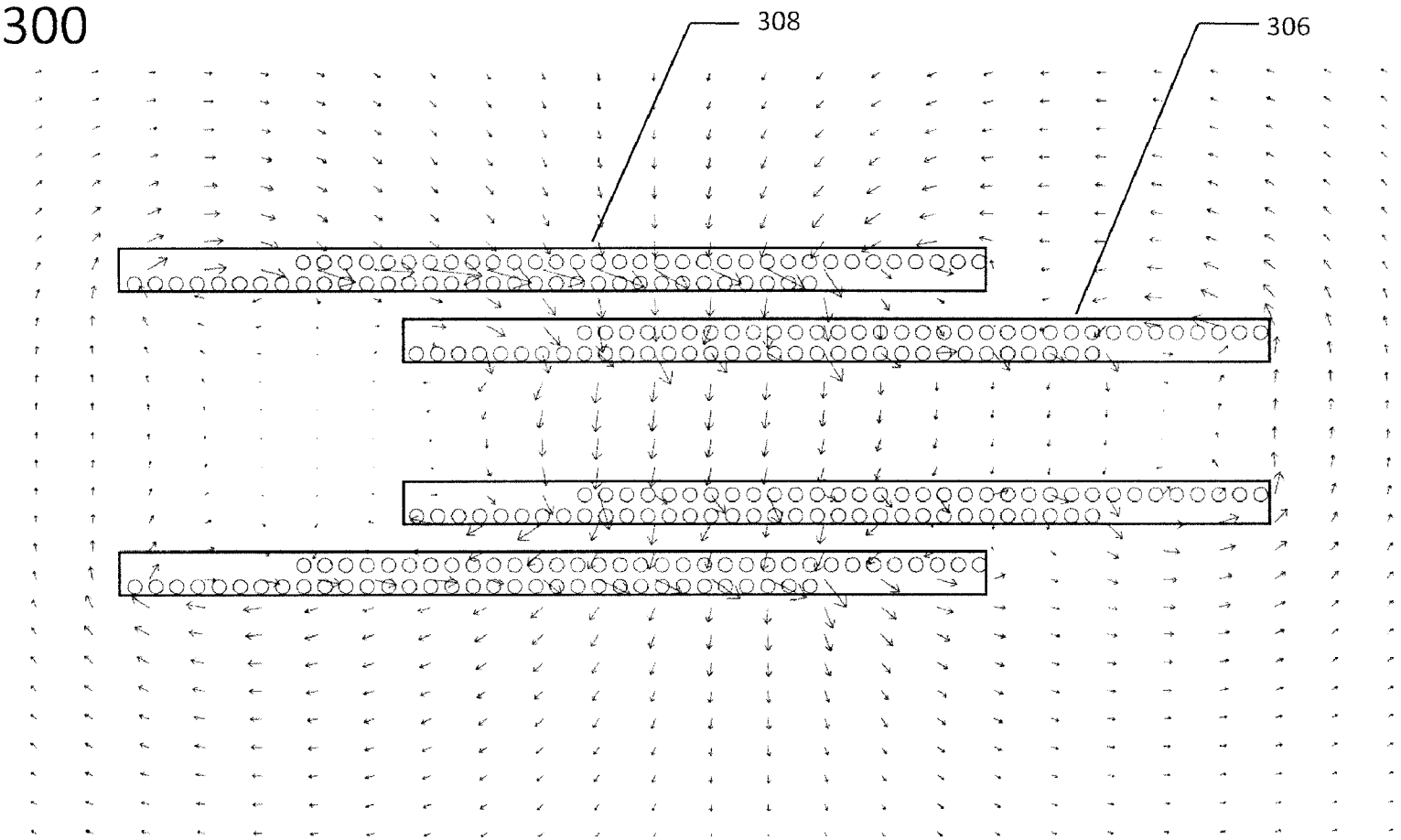
FIG. 19 is a view in cross section of the actuator shown in FIGS. 17 and 18, taken along the central axis and illustrating axial force and flux density vectors.

The advantages of using DDH technology for actuators include provision of relatively fast dynamics due to low mass and low inductances; and provision of high force density due to relatively low resistance. The force density, F, in $N/m^3$ is proportional to $B_{exc}*I_{act}$ wherein $B_{exc}$ is the flux density generated by the excitation component and $I_{act}$ is the current flowing in the acting electromagnet of the actuator. DDH technology enables an increase in both parameters. In summary, actuators based on the DDH technology can provide azimuthal stability during actuation, any combination of axial and transverse field components during actuation, all in a relatively compact, low mass, reliable and energy efficient system. FIG. 17 is a view in cross section of a transverse field actuator 300 taken through the longitudinal axis, corresponding to the X-axis of a coil row. The actuator includes an iron core 302, a yoke 304, an excitation component 306 and an acting (armature) component 308. The excitation component 306 may be one or more pairs of direct double helix coil rows or a permanent magnet. The illustrated acting component comprises one or more pairs of direct double helix coil rows. See, also, FIG. 18 which provides a perspective view of the actuator 300, wherein a first pair of direct double helix coil rows form the excitation component 306 and a second pair of direct double helix coil rows, surrounding the excitation component, serve as the acting component 308. An air gap 310 is between the components 306 and 308. The illustrated coil rows are of a dipole configuration (n=1). FIG. 19 is a view in cross section of the actuator 300, taken along the central axis of the transverse field actuator 300, illustrating axial force during actuation and flux density vectors. Solid arrows represent the electromagnetic force acting on the excitation component 306 (central magnet). The local force is proportional to the size of the arrows.

As is well known, as high speed rotational machines, components of large motors and generators are subjected to a very large accelerations and the associated forces act on the conductors. Containing the elements under these large forces has required positioning a relatively large structural stabilization layer along the air gap between, for example, the rotor and stator of the machine. This reduces the magnitude of the air gap flux and impedes heat exchange between the rotor winding and the ambient air. By way of example, a 50 kW, 100 kRPM conventional machine requires a containment cylinder with a thickness greater than 8 mm and, therefore, an air gap flux of about 100 mT. The weight of such a machine is approximately 25 kg.

A rotor designed with the Direct Double Helix technology can provide higher current density, more efficient force containment and better cooling. Such designs are also easier to manufacture.

The achievable current density is due, in part, to the fact that the excitation magnet is no longer composed of wire wound in slots. Rather, with the direct helix being machined or otherwise formed directly from a cylindrical shaped body, e.g., such as copper or aluminum, the better filling factor, i.e., number of coil turns per unit volume, of such a magnet already bring an important increase of the amount of current allowable in the magnet. In addition to the filling factor, with the variable cross-section of the conducting path the overall resistance of the magnet is reduced, enabling a higher current density for a given heat load.

The coil rows of the Direct Helix design have an inherent robustness in the presence of centrifugal forces, based on the intrinsic material properties and the winding configuration. In coil rows of the direct helix design, each coil row can be covered with a thin layer of insulation such as a fiberglass epoxy. This insulation layer provides an additional function of mechanically stabilizing the layer such that there is not a need for a large containment layer or cylinder adjoining the air gap. That is, with each coil row being mechanically stabilized locally, via an adjoining insulation layer, only a relatively thin insulative layer is needed along the air gap to counter forces for the outermost coil row. Thus a feature of the direct helix design is that the insulative layer between each pair of coil rows in a rotor provides a containment function, resulting in reduced diameter of the rotor. A feature of such designs is that the distances between conductors in the rotor and the stator are reduced.

Rotors incorporating direct helix coil rows exhibit relatively high rates of heat transfer. Each coil row has a thermal path along the surface of the coil row and adjoining insulation layer. This is to be contrasted with a conventional winding for which the path of thermal transfer is through multiple turns. The thermal conduction path in a direct helix coil row is enabled by the presence of a series of thin insulation/containment layers, each between adjacent coil rows. Consequently, the heat transfer in radial direction is greatly improved. Manufacture of direct double helix coil row pairs involves material removal to define the conducting path of interest.

By way of example, a 50 kW, 100 kRPM machine using a DDH rotor requires containment layers of less than 0.5 mm between each helix and an air gap flux of over 350 mT. Such a machine would weigh approximately 10 kg. The power density of a rotating machine can be expressed as follows:

$$P[W/m^3]=\sqrt{2}B_r^0K_sN \qquad \text{Equation 12}$$

where $B^r_0$ is the no-load flux generated by the excitation of the rotor, $K_s$ is the electrical loading of the stator and N the rotation speed. With the use of DDH technology for the rotor coil rows there is an ability to increase both the no-load flux and the stator electrical loading, leading to higher power density. In summary, rotating machinery such as motors and generators, when based on the DDH coil row designs, will exhibit a higher rotor current density, will operate with a relatively small exciter (based on low resistance), and will provide a system characterized by lower weight, smaller size and very good dynamics. Table 2 provides a comparison between a conventional generator and a generator having a rotor based on the DDH design. As can be seen, for a 50 kW power rating and a 100 k RPM speed, the DDH design requires less mass, and much smaller containment layers. The resulting air gap flux is 3.5 times higher for the DDH design.

TABLE 2

| Technology | Power (kW) | RPM | Weight (kg) | Air gap flux density (mT) | Containment (mm) |
|---|---|---|---|---|---|
| Conventional | 50 | 100,000 | 25 | 100 | 8 |
| DDH | 50 | 100,000 | 10 | 350 | 0.5 (per layer) |

Figure 20:
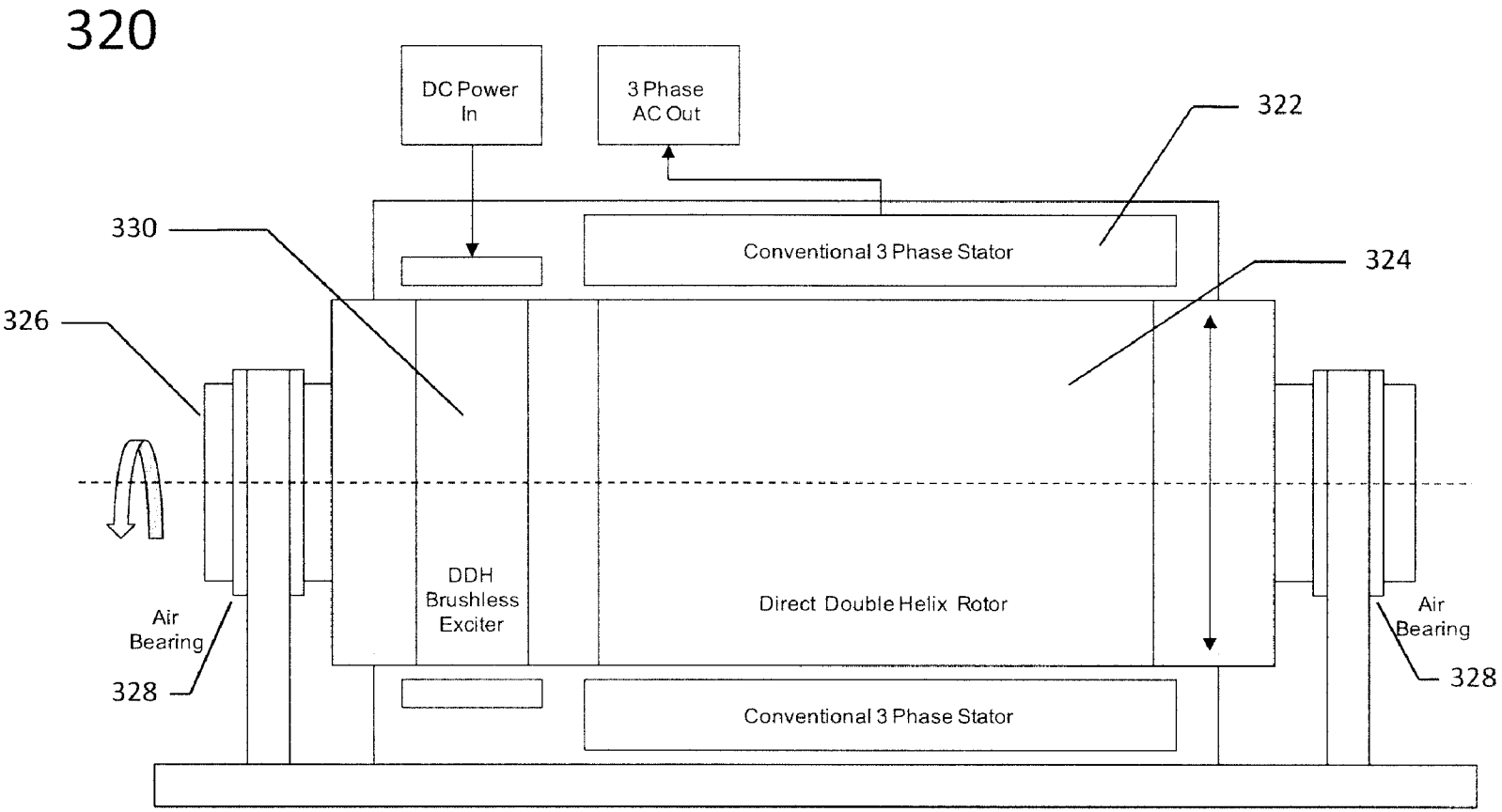
FIG. 20 illustrates a high RPM electrical turbine according to an embodiment of the invention.

FIG. 20 illustrates a high RPM electrical turbine 320 exemplary of a high speed rotational machine incorporating DDH coil rows. The turbine includes a 3-phase stator 322 positioned about a rotor 324 which is coupled to a shaft 326, air bearings 328 and a brushless exciter 330.

While the invention has been described with reference to particular embodiments, it will be understood by those skilled in the art that various changes may be made and equivalents may be substituted for elements thereof without departing from the scope of the invention. For example, although coils have been shown to be symmetric about a straight or curved axis, numerous ones of the disclosed features can be advantageously applied in other applications such as wherein the axis is generally asymmetric. As another example, the aforedescribed cylinders in which helical grooves are formed may have an outer insulative surface (such as an anodization, a deposited coating or other material) under which the conductive layer resides. The insulative surface may be formed prior to or after the groove is formed in the shape.

The scope of the invention is only limited by the claims which follow.

The claimed invention is:

1. A conductor assembly of the type which, when conducting current, generates a magnetic field or which, in the presence of a changing magnetic field, induces a voltage, comprising:

a conductor positioned along a path of variable direction relative to a reference axis, wherein the conductor has a width measurable along an outer surface thereof and along a series of different planes transverse to the path direction, with the measured conductor width varying among the different planes.

2. The assembly of claim 1 wherein the conductor path is a helical shape about an axis and the conductor width varies periodically as a function of position about the axis.

3. The assembly of claim 1 wherein the conductor path is a helical shape about the axis and the conductor width varies as a function of the azimuth angle measurable about the axis in a plane transverse to the axis.

4. The assembly of claim 1 wherein the conductor path is a helical shape about the axis and the conductor width varies periodically as a function of position about the axis.

5. The assembly of claim 1 wherein the conductor path is a helical shape about the axis and the conductor width varies as an increasing function of position along the axis.

6. The assembly of claim 1 wherein the conductor width, $W_s$, includes a minimum width and a maximum width and a variation in width in accord with $$W_s = \frac{d}{\cos(\alpha)}$$

wherein $\alpha$ is the tilt angle along the path of variable direction relative to the reference axis.

7. The assembly of claim 1 wherein the conductor path is helical, positioned about the axis between turns of helical spaces.

8. The assembly of claim 1 wherein the conductor path is a helical shape about the axis and the conductor width varies periodically as a function of position about the axis.

9. A method for constructing a conductor assembly of the type which, when conducting current, generates a magnetic field or which, in the presence of a changing magnetic field, induces a voltage, comprising:

providing a structure having a tube-like shape relative to a reference axis extending through the shape, with a conductive material along an outer surface thereof; and creating a coil row about the reference axis by removing material from the surface with a tool according to an equation of the form: of $$X(\theta)=[h/(2*\pi)]\theta_{+}\Sigma A_n f_i(n\theta)$$

wherein X is a coordinate is along the reference axis coil in an X, Y, Z coordinate system in which Y and Z are coordinates in a plane transverse to the reference axis, θ is the azimuth angle in the Y-Z plane, h is the turn to turn advance of the winding, $A_n$ is a modulation amplitude of $f_1$, herein, the tool thereby defining a variable or constant space width to provide a helical configuration wherein, along a series of different planes transverse to the reference axis the width of the conductor varies.

10. The method of claim 9 wherein the material removal results in a constant space width between conductor loops in the helical configuration and a conductor pattern of variable width as a function of azimuth angle.

11. The method of claim 9 further including forming a multiplicity of additional conductor assemblies each according to the method of claim 9, individual ones of the assemblies being of cylindrical shape and of different diameter, with individual coil rows being of helical shaped conductor, the method including positioning the assemblies of different diameters concentrically about one another.

12. The method of claim 11 further including serially connecting the helical shaped conductor in each row to the helical shaped conductor in another row to create a multi-layer coil.

13. The method of claim 9 wherein the step of creating the coil row about the reference axis by removing material from the surface with a tool is in further accord with $$Y(\theta)=Rf_2(\theta)$$

$$Z(\theta)=Rf_3(\theta)$$

wherein R is a measurable radius with respect to one or more surfaces of the winding, measured from the reference axis.

14. The method of claim 13 wherein the step of creating the coil row about the reference axis by removing material from the surface with a tool is in accord with equation of the form:

$$X(\theta) = \frac{h}{2\cdot\pi}\cdot\theta + \sum_n A_n \cdot \sin(n\cdot\theta + \phi_n)$$

$$Y(\theta) = R\cdot\cos(\theta)$$

$$Z(\theta) = R\cdot\sin(\theta)$$

wherein, for a given value of n, ϕ is a phase advance for a sinusoidal modulation.

15. A conductor assembly of the type which, when conducting current, generates a magnetic field or which, in the presence of a changing magnetic field, induces a voltage, comprising:

a conductor positioned along a path of variable direction relative to a reference axis, the conductor having a groove formed therethrough of width $W_g$ in accord with a center line defined by $$X(\theta)=[h/(2*\pi)]\theta\pm\Sigma A_n f_1(n\theta)$$

$$Y(\theta)=Rf_2(\theta)$$

$$Z(\theta)=Rf_3(\theta)$$

the conductor thereby providing at least a first coil row wherein X is a coordinate is along the reference axis coil, Y and Z are coordinates in a plane transverse to the reference axis, θ is the azimuth angle in the Y-Z plane, h is the turn to turn advance of the winding, $A_n$ is a modulation amplitude of $f_1$, and R is a measurable radius with respect to one or more surfaces of the winding, measured from the reference axis, the conductor having first and second opposing conductor surface regions each extending different distances R from the reference axis so that, at positions along the conductor path, portions of the first conductor surface region extend farther away from the reference axis than portions of the second conductor surface region, the conductor characterized at each of multiple different path positions by a cross sectional shape along a plane orthogonal to the path direction, the multiple cross sectional shapes varying among different path positions.

16. The assembly of claim 15 comprising a plurality of conductive additional coil rows each formed of a conductive tubular core into which a groove of constant width $W_g$ is formed in accord with a center line defined by equations of the form $$X(\theta)=[h/(2*\pi)]\theta\pm\Sigma A_n f_1(n\theta)$$

$$Y(\theta)=Rf_2(\theta)$$

$$Z(\theta)=Rf_3(\theta)$$

wherein, for each additional coil row, R' is radius with respect to one or more conductive surfaces of the additional coil row measured from the reference axis, thereby providing a conductor of variable width at each of multiple path positions along each of the additional coil rows.

17. The assembly of claim 15 with the first surface region having along each cross sectional shape a first position characterized by a first distance closest to the reference axis and a second position characterized by a second distance farthest from the reference axis, with the second distance greater than the first distance.

18. A method of forming a conductor assembly comprising:

providing a plurality of conductive rows comprising a conductive layer;

forming a groove through the conductive layer in each row to define a helical conductive path, wherein each groove extends beyond the helical path to define a line-in terminal and a line-out terminal in the conductive layer;

positioning the conductive rows in a concentric configuration; and interconnecting line-in and line-out terminals of different conductive rows to provide a continuous current path among the different conductive rows in the assembly.

19. The method of claim 18 wherein one of the conductive rows is formed of a tubular structure from a sheet.

20. The method of claim 19 wherein the sheet is formed into a closed cylindrical shape and the groove is formed in the sheet with a constant width.

* * * * *